US006821721B2

(12) United States Patent
Yoshioka

(10) Patent No.: US 6,821,721 B2
(45) Date of Patent: Nov. 23, 2004

(54) PHOTOTHERMOGRAPHIC MATERIAL

(75) Inventor: Yasuhiro Yoshioka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/414,565

(22) Filed: Apr. 16, 2003

(65) Prior Publication Data

US 2003/0203330 A1 Oct. 30, 2003

(30) Foreign Application Priority Data

Apr. 16, 2002 (JP) ..... P. 2002-113351

(51) Int. Cl.[7] ..... G03C 1/1498; G03C 1/38

(52) U.S. Cl. ..... 430/619; 430/264; 430/607; 430/610; 430/620; 430/631

(58) Field of Search ..... 430/619, 631, 430/620, 610, 607, 264

(56) References Cited

U.S. PATENT DOCUMENTS 4,968,599 A * 11/1990 Pitt et al. ..... 430/631
5,677,121 A * 10/1997 Tsuzuki ..... 430/619
6,548,240 B2 * 4/2003 Yamaguchi ..... 430/619
6,589,723 B2 * 7/2003 Yamanouchi et al. ..... 430/529
2002/0042034 A1 * 4/2002 Yoshioka ..... 430/620
2003/0008251 A1 * 1/2003 Yamaguchi ..... 430/598
2003/0087204 A1 * 5/2003 Oyamada et al. ..... 430/350
2003/0138740 A1 * 7/2003 Yamada ..... 430/350
2003/0190565 A1 * 10/2003 Fujiwara et al. ..... 430/610

FOREIGN PATENT DOCUMENTS

JP 2002-82411 A 3/2002

* cited by examiner

*Primary Examiner*—Thorl Chea
(74) *Attorney, Agent, or Firm*—Sughrue Mion, PLLC

(57) ABSTRACT

A photothermographic material comprising: a substrate; and a photosensitive silver halide, a non-photosensitive organic silver salt, a reducing agent and a binder, in a same region defined by the substrate, wherein the photothermographic material further comprises a fluorine compound which comprises at least one fluoroalkyl group having 2 or more of carbon atoms and not more than 13 of fluorine atoms and at least one of anionic and nonionic hydrophilic groups, and 40 to 98% by mol of the non-photosensitive organic silver salts are silver behenate.

15 Claims, No Drawings

PHOTOTHERMOGRAPHIC MATERIAL

FIELD OF THE INVENTION

This invention relates to a photothermographic material. More specifically, it relates to a photothermographic material wherein a specific fluorine compound is employed so as to lessen changes in photographic properties of the photothermographic material in the storage state and under environmental conditions in using.

BACKGROUND OF THE INVENTION

In recent years, it has been strongly required in the field of medicine to reduce the volume of liquid wastes from the viewpoints of environmental protection and space saving. Accordingly, there have been needed techniques concerning photosensitive thermographic materials for medical diagnosis and photographic uses which can be efficiently exposed with a laser image setter or a laser imager so as to give vivid black images having a high resolution and an excellent sharpness. Use of these photosensitive thermographic materials makes it possible to supply to clients a more convenient thermal development system which is nondetrimental to the environment since no chemical is needed for solvent treatments.

Although there arises the same demand in the filed of general image forming materials, high image qualities with an excellent sharpness and graininess are necessary in medical images which should be finely formed. Moreover, there is an additional feature that images in a cool black tone are preferred from the viewpoint of convenience in diagnosing. Although various hard copy systems with the use of pigments and dyes such as ink jet printers and electrophotographs are commonly employed today as image forming systems, there is no output system satisfactory for medical images.

On the other hand, there have been reported thermal image forming systems using organic silver salts, for example, "Thermally Processed Silver Systems" described in U.S. Pat. Nos. 3,152,904 and 3,457,075 and B. Shely (Image Processes and Materials) Neblette, 8th ed., Sturge, V. Walcorth, ed. by A. Shepp, p.2 (1996). In particular, a photothermographic material generally has a photosensitive layer wherein a catalytically active amount of a photocatalyst (for example, a silver halide), a reducing agent and a reducible silver salt (for example, an organic silver salt) together with, if needed, a color tone controller which controls the silver color tone are dispersed in a binder matrix. After exposure, the photothermographic material is heated to a high temperature (for example, 80° C. or above). Thus, the silver halide or the reducible silver salt (serving as an oxidizing agent) and the reducing agent undergo a redox reaction to thereby form a silver image in a black color. The redox reaction is accelerated by the catalytic action of the latent image of the silver halide formed by the exposure. Therefore, the silver image in the black color is formed in the exposed region. Fuji Medical Dry Imager FM-DP L has been disclosed in a number of documents including U.S. Pat. No. 2,910,377 and JP-B-43-4924 and put into the market as a medical image forming system with the use of a photothermographic material.

To produce a thermal image forming system with the use of an organic silver halide, use is made of a production method wherein a coating solution containing a solution of a main binder polymer dissolved in an organic solvent is applied and dried, or another production method wherein an aqueous coating solution containing an aqueous dispersion of fine grains of a main binder polymer is applied and dried. Since no solvent recovery step is needed in the latter method, it can be carried out by using a simple production apparatus and is advantageous in mass production.

Owing to the characteristics as described above, photothermographic materials have gained popularity in the market. Thus, they have been employed in expanding fields and sites. With this tendency, it has been required to further improve the performance thereof. Among all, it is frequently required to improve the finishing stability and, therefore, attempts have been vigorously made to improve the storage properties and using environment-dependency of photothermographic materials.

SUMMARY OF THE INVENTION

An object of the invention is to lessen changes in photographic performance of a photothermographic material in the storage state. Another object thereof is to lessen changes in photographic performance caused by the environmental temperature and humidity in using a photothermographic material. Thus, it is intended to provide a photothermographic material showing lessened changes in the photographic performance as described above.

The objects of the invention have been achieved by the following photothermographic materials.

(1) A photothermographic material containing, on one side of a substrate, at least one photosensitive silver halide, non-photosensitive organic silver salts, a reducing agent for thermal development and a binder, characterized by containing a fluorine compound having one or more fluoroalkyl groups carrying 2 or more carbon atoms and not more than 13 fluorine atoms and at least one of anionic and nonionic hydrophilic groups, and silver behenate amounting to 40 to 98% by mol of the non-photosensitive organic silver salts.

(2) A photothermographic material as described in the above (1) characterized in that the fluorine compound is a compound represented by the following formula (F).

Formula (F):

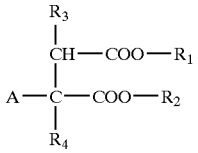

wherein $R^1$ and $R^2$ represent each a substituted or unsubstituted alkyl group and at least one of them represents a fluoroalkyl group carrying 2 or more carbon atoms and not more than 13 fluorine atoms; $R^3$ and $R^4$ represent each a hydrogen atom or an alkyl group; and A represents $—L_b—SO_3—M$ (wherein M represents a hydrogen atom or a cation; and $L_b$ represents a single bond or a substituted or unsubstituted alkylene group.

(3) A photothermographic material as described in the above (2) characterized in that, in the compound represented by the formula (F), $R^3$ and $R^4$ are both hydrogen atoms.

(4) A photothermographic material as described in the above (2) or (3) characterized in that, in the compound represented by the formula (F), $L_b$ is a $—CH_2—$ group.

(5) A photothermographic material as described in any of the above (2) to (4) characterized in that, in the compound represented by the formula (F), at least one of $R^1$ and $R^2$ is a fluoroalkyl group carrying 4 or more carbon atoms and not more than 11 fluorine atoms.

(6) A photothermographic material as described in any of the above (2) to (4) characterized in that, in the compound represented by the formula (F), $R^1$ and $R^2$ are each a fluoroalkyl group carrying 4 or more carbon atoms and not more than 11 fluorine atoms.

(7) A photothermographic material as described in any of the above (1) to (6) characterized in that silver behenate amounts to 50 to 85% by mol of the non-photosensitive organic silver salts.

(8) A photothermographic material as described in any of the above (1) to (7) characterized in that the total coating dose of silver is 1.9 g/$m^2$ or less.

(9) A photothermographic material as described in the above (8) characterized in that the total coating dose of silver is 1.6 g/$m^2$ or less.

(10) A photothermographic material as described in any of the above (1) to (9) characterized in that the reducing agent for thermal development is represented by the following formula (R):

(R)

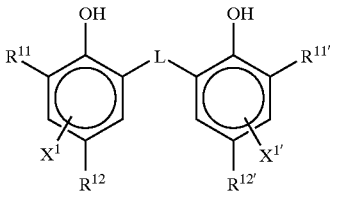

wherein $R^{11}$ and $R^{11'}$ independently represent each an alkyl group having 1 to 20 carbon atoms; $R^{12}$ and $R^{12'}$ independently represent each a hydrogen atom or a substituent capable of attaching to a benzene ring; L represents a —S— group or a —$CHR^{13}$— group (wherein $R^{13}$ represents a hydrogen atom or an alkyl group having 1 to 20 carbon atoms); and $X^1$ and $X^{1'}$ independently represent each a hydrogen atom or a group capable of attaching to a benzene ring as a substituent.

(11) A photothermographic material as described in any of the above (1) to (10) characterized by containing a compound represented by the formula (D) in the same side of the substrate as the image forming layer:

(D)

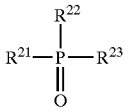

wherein $R^{21}$ to $R^{23}$ independently represent each an alkyl group, an aryl group, an alkoxy group, an aryloxy group, an amino group or a heterocyclic group which may be either unsubstituted or substituted.

(12) A photothermographic material as described in any of the above (1) to (11) characterized by containing a compound represented by the formula (H) in the same side of the substrate as the image forming layer:

$$Q—(Y)n—C(Z_1)(Z_2)X \quad (H)$$

wherein Q represents an alkyl group, an aryl group or a heterocyclic group; Y represents a divalent linking group; n is 0 or 1; $Z_1$ and $Z_2$ represent each a halogen atom; and X represents a hydrogen atom or an electron-withdrawing group.

(13) A photothermographic material as described in any of the above (1) to (12) characterized by containing a development accelerator having an effect of accelerating thermal development on the reducing agent for thermal development represented by the formula (R).

(14) A photothermographic material as described in the above (13) characterized in that the development accelerator is a hydrazine compound.

(15) A photothermographic material characterized in that the compound represented by the formula (F) is contained in the undercoating layer of the substrate.

(16) A photothermographic material as described in any of the above (1) to (14) characterized in that the compound represented by the formula (F) is contained in the undercoating layer of the substrate.

DETAILED DESCRIPTION OF THE INVENTION

Now, the invention will be illustrated in greater detail.

Illustration of Fluorine Compound

The photothermographic material according to the invention contains a fluorine compound having one or more fluoroalkyl groups carrying 2 or more carbon atoms and not more than 13 fluorine atoms and at least one of anionic and nonionic hydrophilic groups (hereinafter sometimes referred to as "the specific fluorine compound").

The fluorine compound to be used in the invention may have an arbitrary structure, so long as it carries one or more fluoroalkyl groups as described above and either an anionic hydrophilic group or a nonionic hydrophilic group.

Specific examples of the fluoroalkyl group is as follows:

a —$C_2F_5$ group, a —$C_3F_7$ group, a —$C_4F_9$ group, a —$C_5F_{11}$ group, a —$CH_2$—$C_4F_9$ group, a —$C_4F_8$—H group, a —$C_2H_4$—$C_4F_9$ group, a —$C_4H_8$—$C_4F_9$ group, a —$C_6H_{12}$—$C_4F_9$ group, a —$C_8H_{16}$—$C_4F_9$ group, a $C_4H_8$—$C_2F_5$ group, a $C_4H_8$—$C_3F_7$ group, a $C_4H_8$—$C_5F_{11}$ group, a $C_8H_{16}$—$C_2F_5$ group, a $C_2H_4$—$C_4F_8$—H group, a $C_4H_8$—$C_4F_8$—H group, a $C_6H_{12}$—$C_4$ $F_8$—H group, a $C_6H_{12}$—$C_2F_4$—H group, a $C_8H_{16}$—$C_2F_4$—H group, a $C_6H_{12}$—$C_4F_8$—$cH_3$ group, a $C_2H_4$—$C_3F_7$ group, a $C_2H_4$—$C_5F_{11}$ group, a $C_4H_8$—$CF(CF_3)_2$ group, a $CH_2CF_3$ group, a $C_4H_8$—$CH(C_2F_5)_2$ group, a $C_4H_8$—$CH(CF_3)_2$ group, a $C_4H_8$—$C(CF_3)_3$ group, a —$CH_2$—$C_4F_8$—H group, a —$CH_2$—$C_6F_{12}$—H group and a —$CH_2CH_2$—$C_6F_{13}$ group.

The fluoroalkyl group of the fluorine compound to be used in the invention has not more than 13 fluorine atoms, preferably from 3 to 12 and still preferably from 5 to 9 fluorine atoms. Also, it has 2 or more carbon atoms, preferably from 4 to 16, still preferably from 5 to 12 and still preferably from 6 to 10 carbon atoms.

It is preferable that the fluorine compound to be used in the invention has 2 or more fluoroalkyl groups having 2 or more carbon atoms and not more than 13 fluorine atoms. From the viewpoint of easiness in synthesis, it is preferable that these 2 or more fluoroalkyl groups are the same.

It is preferable that the fluoroalkyl groups of the fluorine compound to be used in the invention are the groups represented by the following formula (1).

Formula (1):

—Lb—Raf—W

In the formula (1), Lb represents a substituted or unsubstituted alkylene group, a substituted or unsubstituted alkyleneoxy group or a divalent group formed by combining these groups. Although the substituent may be an arbitrary group, preferable examples thereof include an alkenyl group, an aryl group, an alkoxy group, a halogen atom (preferably C1), a carboxylate group, a carbonamide group, a carbamoyl group, an oxycarbonyl group and a phosphate group.

It is preferable that Lb has 8 or less, still preferably 4 or less, carbon atoms. It is also preferable that Lb is an unsubstituted alkylene.

Raf represents a perfluoroalkylene group having 1 to 6 carbon atoms, preferably a perfluoroalkylene group having 2 to 4 carbon atoms. The term "perfluoroalkylene group" as used herein means an alkylene group in which all of the hydrogen atoms of an alkylene group have been substituted by fluorine atoms. The perfluoroalkylene group may have either a linear, branched or cyclic structure.

W represents a hydrogen atom, a fluorine atom or an alkyl group. It is preferable that W is a hydrogen atom or a fluorine atom.

The term "anionic hydrophilic group" means an acidic group having pKa of 7 or less or an alkali metal salt or an ammonium salt thereof. Specific examples thereof include a sulfo group, a carboxyl group, a phosphonate group, a carbamoylsulfamoyl group, a sulfamoylsulfamoyl group, an acylsulfamoyl group and salts thereof. Among these groups, a sulfo group, a carboxyl group, a phosphonate group and salts thereof are preferable and a sulfo group and salts thereof are still preferable. Examples of the cation species forming the salts include lithium, sodium, potassium, cesium, ammonium, tetramethylammonium, tetrabutylammonium, methylpyridinium and the like and lithium, sodium, potassium and ammonium are preferable.

Examples of the nonionic hydrophilic group include a hydroxyl group and polyalkyleneoxy groups. Polyalkyleneoxy groups are preferable therefor.

The fluorine compound may have a polyoxyalkylene group and the anionic hydrophilic group as described above at the same time in a single molecule. This structure is preferable in the invention. It is effective and thus particularly preferable to use an anionic compound together with a nonionic compound.

A fluorine compound still preferable in the invention is represented by the following formula (F).

Formula (F):

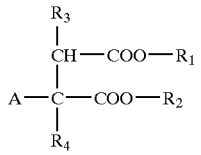

In the formula (F), $R^1$ and $R^2$ independently represent each a substituted or unsubstituted alkyl group and at least one of them represents a fluoroalkyl group carrying 2 or more carbon atoms and not more than 13 fluorine atoms. In the case where $R^1$ and $R^2$ represent alkyl groups other than a fluoroalkyl group, alkyl groups having 2 to 18 carbon atoms are preferable and alkyl groups having 4 to 12 carbon atoms are still preferable. $R^3$ and $R^4$ independently represent each a hydrogen atom or a substituted or unsubstituted alkyl group.

Specific examples of the fluoroalkyl group represented by $R^1$ and $R^2$ include the groups cited above. Similarly, the structures represented by the formula (1) may be cited as preferable structures thereof. Preferable structures among these structures are also the same as the ones cited above concerning the fluoroalkyl groups. It is preferable that the alkyl groups represented by $R^1$ and $R^2$ are both the fluoroalkyl groups as described above.

The substituted or unsubstituted alkyl groups represented by $R^3$ and $R^4$ may have either linear, branched or cyclic structures. Although the substituent may be an arbitrary group, preferable examples thereof include an alkenyl group, an aryl group, an alkoxy group, a halogen atom (preferably Cl), a carboxylate group, a carbonamide group, a carbamoyl group, an oxycarbonyl group and a phosphate group.

A represents $—L_b—SO_3—M$ wherein M represents a cation. Preferable examples of the cation represented by M include alkali metal ions (for example, a lithium ion, a sodium ion, a potassium ion and the like), alkaline earth metal ions (a barium ion, a calcium ion and the like), an ammonium ion and the like. Among these cations, a lithium ion, a sodium ion, a potassium ion and an ammonium ion are still preferable. Moreover, a lithium ion, a sodium ion and a potassium ion are still preferable. An appropriate cation may be selected depending on, for example, the total carbon atom number, substituents and the degree of branching of the alkyl group of the compound represented by the formula (F). In the case where the total carbon atom number in $R^1$, $R^2$, $R^3$ and $R^4$ is 16 or more, it is preferable to use a lithium ion as M from the viewpoint of the compatibility between the solubility (particularly in water) and the antistatic performance or the coating uniformity.

$L_b$ represents a single bond or a substituted or unsubstituted alkylene group. As the substituent, those cited above concerning $R^3$ are preferable. In the case where $L_b$ is an alkylene group, it preferably has 2 or less carbon atoms. It is preferable that $L_b$ is a single bond or a $—CH_2—$ group and a $—CH_2—$ group is the most desirable.

In the formula (F), it is preferable to combine the respective preferable embodiments as described above with each other.

Specific examples of the fluorine compound to be used in the invention are as follows, though the invention is never restricted to these specific examples.

Unless otherwise noted, the alkyl groups and the perfluoroalkyl groups in the structures of the following example compounds have linear structures.

(F-1)

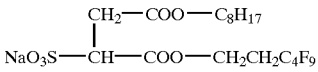

(F-2)

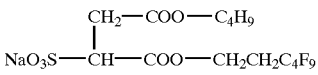

(F-3)

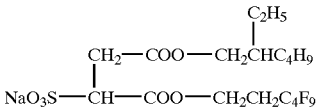

(F-4)

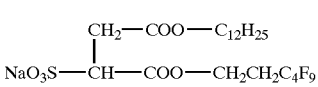

(F-5)

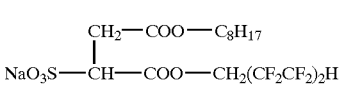

-continued (F-6)

$$NaO_3S-CH(CH_2-COO-C_8H_{17})-COO-CH_2(CF_2CF_2)_3H$$

(F-7)

$$NaO_3S-CH(CH_2-COO-CH_2CH_2C_4F_9)-COO-C_6H_{13}$$

(F-8)

$$NaO_3S-CH(CH_2-COO-CH_2(CF_2CF_2)_2H)-COO-CH_2CH(C_2H_5)C_4H_9$$

(F-9)

$$NaO_3S-CH(CH_2-COO-C_8H_{17})-COO-CH_2C_5F_{11}$$

(F-10)

$$NaO_3S-CH(CH_2-COO-C_4H_9)-COO-CH_2CH_2(CF_2CF_2)_3H$$

(F-11)

$$NaO_3S-CH(CH_2-COO-C_{10}H_{21})-COO-C_4F_9$$

(F-12)

$$NaO_3S-CH(CH_2-COO-(CH_2CH_2O)n-C_4H_9)-COO-CH_2CH_2C_4F_9$$

n = 5 ~ 15

(F-13)

$$NaO_3SCH_2-CH(CH_2-COO-C_8H_{17})-COO-CH_2CH_2C_4F_9$$

(F-14)

$$NaO_3SCH_2-CH(CH_2-COO-CH_2CH_2C_4F_9)-COO-C_{12}H_{25}$$

(F-15)

$$NaO_3SCH_2-CH(CH_2-COO-C_8H_{17})-COO-CH_2(CF_2CF_2)_2H$$

(F-16)

$$NaO_3SCH_2-CH(CH_2-COO-CH_2(CF_2CF_2)_3H)-COO-CH_2CH(C_2H_5)C_4H_9$$

(F-17)

$$NaO_3S-CH(CH_2-COO-CH_2CH_2C_4F_9)-COO-CH_2CH_2C_4F_9$$

(F-18)

$$NaO_3S-CH(CH_2-COO-CH_2CH_2C_3F_7)-COO-CH_2CH_2C_3F_7$$

(F-19)

$$NaO_3S-CH(CH_2-COO-CH_2CH_2C_5F_{11})-COO-CH_2CH_2C_5F_{11}$$

(F-20)

$$NaO_3S-CH(CH_2-COO-CH_2C_4F_9)-COO-CH_2C_4F_9$$

(F-21)

$$NaO_3S-CH(CH_2-COO-C_4F_9)-COO-C_4F_9$$

(F-22)

$$NaO_3S-CH(CH_2-COO-C_4F_9)-COO-CH_2CH_2C_4F_9$$

(F-23)

$$NaO_3S-CH(CH_2-COO-CH_2CH_2CF(CF_3)_2)-COO-CH_2CH_2CF(CF_3)_2$$

-continued (F-24)

$$NaO_3S-CH(CH_2-COO-CH_2CH_2C_2F_5)-COO-CH_2CH_2C_4F_9$$

(F-25)

$$NaO_3S-CH(CH_2-COO-CH_2(CF_2CF_2)_2H)-COO-CH_2(CF_2CF_2)_2H$$

(F-26)

$$NaO_3S-CH(CH_2-COO-CH_2(CF_2CF_2)_3H)-COO-CH_2(CF_2CF_2)_3H$$

(F-27)

$$NaO_3S-CH(CH_2-COO-CH_2CF_2CF_2H)-COO-CH_2(CF_2CF_2)_3H$$

(F-28)

$$NaO_3S-CH(CH_2-COO-(CH_2CH_2O)nC_4F_9)-COO-(CH_2CH_2O)nC_4F_9$$

n = 5 ~ 15

(F-29)

$$NaO_3SCH_2-CH(CH_2-COO-CH_2CH_2C_4F_9)-COO-CH_2CH_2C_4F_9$$

(F-30)

$$NaO_3SCH_2-CH(CH_2-COO-CH_2CH_2C_3F_7)-COO-CH_2CH_2C_3F_7$$

(F-31)

$$NaO_3SCH_2-CH(CH_2-COO-CH_2CH_2C_5F_{11})-COO-CH_2CH_2C_5F_{11}$$

(F-32)

$$NaO_3SCH_2-CH(CH_2-COO-CH_2CH_2C_6F_{13})-COO-CH_2CH_2C_6F_{13}$$

(F-33)

$$NaO_3SCH_2-CH(CH_2-COO-CH_2(CF_2CF_2)_2H)-COO-CH_2(CF_2CF_2)_2H$$

(F-34)

$$NaO_3SCH_2-CH(CH_2-COO-CH_2(CF_2CF_2)_3H)-COO-CH_2(CF_2CF_2)_3H$$

(F-35)

$$NaO_3SCH_2-CH(CH_2-COO-CH_2CF_2CF_2H)-COO-CH_2(CF_2CF_2)_3H$$

(F-36)

$$NaO_3SCH_2-CH(CH_2-COO-CH_2CH_2CF(CF_3)_2)-COO-CH_2CH_2CF(CF_3)_2$$

(F-37)

$$NaO_3SCH_2-CH(CH_2-COO-CH_2CH(C_2F_5)_2)-COO-CH_2CH(C_2F_5)_2$$

(F-38)

$$NaO_3S-CH(CH_3)-CH(CH_2-COO-CH_2CH_2C_4F_9)-COO-CH_2CH_2C_4F_9$$

(F-39)

$$NaO_3S-CH(CH-COO-CH_2CH_2C_4F_9)-CH(CH-COO-CH_2CH_2C_4F_9)-COO-CH_2CH_2C_4F_9$$

(F-40)

$$NaO_3S-CH(CH-COO-CH_2(CF_2C_2F)_2H)-CH(CH-COO-CH_2(CF_2CF_2)_2H)-COO-CH_2(CF_2CF_2)_2H$$

-continued (F-41)

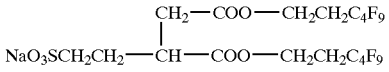

(F-42)

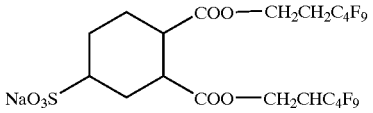

(F-43)

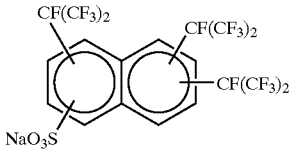

(F-44)

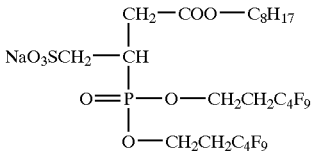

(F-45)

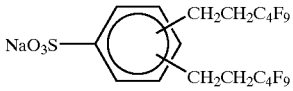

(F-46)

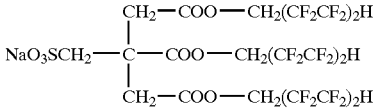

(F-47)

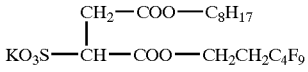

(F-48)

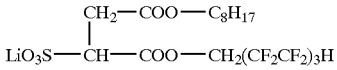

(F-49)

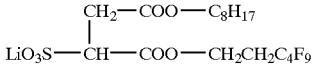

(F-50)

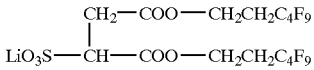

(F-51)

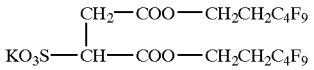

(F-52)

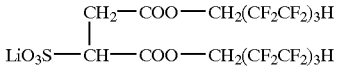

(F-53)

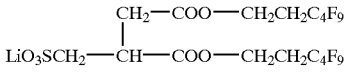

(F-54)

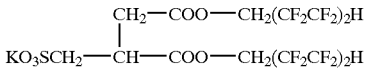

(F-55)

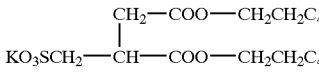

(F-56)

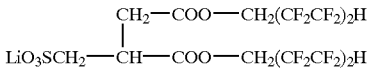

Compounds having a fluoroalkyl group including the specific fluorine compound to be used in the invention have been preferably employed as surfactants in coating compositions for forming layers constituting silver halide photosensitive materials (in particular, protective layers, undercoating layers, backlayers and the like). Among all, it is particularly preferable to use these compounds in forming a hydrophilic colloidal layer serving as the uppermost layer of photosensitive materials, since an effective antistatic performance and a high coating uniformity can be thus established. The specific fluorine compound according to the invention is useful because of showing similar effects. Moreover, it has been found out that use of the specific fluorine compound in the structure according to the invention is effective in improving the storage stability and the using environment-dependency as intended in the invention. To achieve these effects, it is preferable to use the fluorine compound according to the invention in the outermost layer of the emulsion face or the back face. Also, similar effects can be obtained by using it in the undercoating layer of the substrate.

Next, a coating composition containing the specific fluorine compound as described above which is to be used in producing the photothermographic material according to the invention will be illustrated.

An aqueous coating solution to be used in producing the photothermographic material according to the invention contains the specific fluorine compound as described above and a medium in which the compound is to be dissolved and/or dispersed. If needed, it may also contain a surfactant other than the specific fluorine compound. Moreover, it may contain other appropriate components depending on the purpose. As the medium to be used in the aqueous coating solution to be used in producing the photothermographic material according to the invention, an aqueous medium is preferable. Examples of the aqueous medium include water and mixtures of organic solvents other than water (for example, methanol, ethanol, isopropyl alcohol, n-butanol, methyl cellosolve, dimethylformamide, acetone and the like) with water. In the invention, it is preferable that the medium of the coating composition contains water in an amount of 50% by weight or more.

In the invention, use can be made of either one of the specific fluorine compounds as described above or a mixture of two or more thereof. It is also possible to use another surfactant together with the specific fluorine compound. Examples of the surfactant which can be used together include anionic, cationic and nonionic surfactants. The surfactant to be used together may be either a polymer surfactant or a fluorine-based surfactant other than the specific fluorine compound. It is still preferable to use an anionic or nonionic surfactant as the surfactant to be used together. Examples of the surfactants which can be used together include the surfactants cited in, for example, JP-A-62-215272 (pp. 649 to 706), Research Disclosure (RD) Item 17643, pp. 26 to 27 (December, 1978), ibid. 18716, p. 650 (November, 1979), ibid. 307105, pp. 875 to 876 (December, 1989) and so on.

As a typical example of other components which can be used together, a polymer compound can be cited. This polymer compound may be a polymer soluble in the aqueous medium (hereinafter referred to as a "soluble polymer") or an aqueous dispersion of a polymer (i.e., a so-called polymer latex). Examples of the soluble polymer include gelatin, polyvinyl alcohol, casein, agar, acacia, hydroxyethylcellulose, methylcellulose, carboxymethylcellulose and the like, though the invention is not restricted thereto. Examples of the polymer latex include dispersions (for example, polyester, polyurethane, polycarbonate and polyamide) of homopolymers, copolymers and condensed polymers of various vinyl monomers [for example, acrylate derivatives, methacrylate derivatives, acrylamide derivatives, methacrylamide derivatives, styrene derivatives, conjugated diene derivatives, N-vinyl compounds, O-vinyl compounds, vinyl nitrile, other vinyl compounds (for example, ethylene, vinylidene chloride)]. Specific examples of polymer compounds of these types include the polymer compounds described in, for example, JP-A-62-215272 (pp. 707 to 763), Research Disclosure (RD) Item 17643, p. 651 (December, 1978), ibid. 18716, p. 650 (November, 1979), ibid. 307105, pp. 873 to 874 (November, 1989) and so on.

The aqueous coating composition containing the fluorine compound to be used in producing the photothermographic material according to the invention may further contain other various compounds depending on the layer of the photothermographic material in which it is to be employed. These compounds may be dissolved in the medium or dispersed therein. Examples of these compounds include various couplers, UV absorbers, color-mixing inhibitors, antistatic agents, scavengers, antifogging agents, film hardeners, dyes, mildew-proofing agents and so on. As described above, it is preferable to use the aqueous coating composition containing the specific fluorine compound in forming a hydrophilic colloidal layer serving as the uppermost layer of a photothermographic material. In this case, the coating composition may contain, in addition to a hydrophilic colloid (for example, gelatin) and the specific fluorine compound as described above, another surfactant, a matting agent, a slipping agent, colloidal silica, a gelatin plasticizer or the like.

The amount of the specific fluorine compound to be used in the invention is not particularly restricted but can be arbitrarily determined depending on the structure of the fluorine compound employed, the place where it is used, the contents and types of other materials contained in the composition and soon. In case where it is employed as a coating solution for the hydrophilic colloidal (gelatin) layer serving as the uppermost layer of a photothermographic material, for example, it is preferable that the concentration of the fluorine compound in the coating composition ranges from 0.003 to 0.5% by weight while the content thereof based on the solid gelatin content ranges from 0.03 to 5% by weight.

Illustration of Organic Silver Salts

The organic silver salts usable in the invention are silver salts which are relatively stable to light but serve as a silver ion donor to thereby form a silver image when heated to 80° C. or above in the presence of a exposed sensitive silver halide and a reducing agent. The photothermographic material according to the invention contains from 50% by mol to 98% by mol of silver behenate as the organic silver salt.

In addition to silver behenate, the photothermographic material may contain an arbitrary organic substance which can be reduced by a reducing agent to thereby supply silver ion. These non-photosensitive organic silver salts are described in, for example, JP-A-10-62899, Paragraph Nos. 0048 to 0049, European Patent No. 0803764A1, p. 18, 1. 24 to p. 19, 1. 37, European Patent No. 0962812A1, JP-A-11-349591, JP-A-2000-7683, JP-A-2000-72711 and so on. Among all, silver salts of organic acids, in particular, silver salts of long chain (having from 10 to 30, preferably 15 to 28, carbon atoms) aliphatic carboxylic acids are preferable. Preferable examples of the aliphatic fatty acid silver salts include silver lignocerate, silver behenate, silver arachidate, silver stearate, silver oleate, silver laurate, silver capronate, silver myristate, silver palmitate, silver erucate and mixtures thereof.

As described above, in the present invention, it is preferable to use fatty acid silver salts having a silver behenate content of from 40% by mol to 98% by mol, preferably from 50% by mol to 95% by mol, still preferably from 60% by mol to 90% by mol and still preferably from 65% by mol to 85% by mol. In a design thinking a great deal of image storage properties, the silver behenate content preferably ranges from 70% by mol to 98% by mol, still preferably from 80% by mol to 98% by mol. In a design thinking a great deal of thermal development activity and speed, the silver behenate content preferably ranges from 50% by mol to 85% by mol, still preferably from 55% by mol to 80% by mol. Moreover, it is preferable to use fatty acid silver salts containing 2% by mol or less, still preferably 1% by mol or less and still preferably 0.1% by mol or less of silver erucate.

The organic silver salts usable in the invention are not particularly restricted in form. Namely, these organic silver salts may be in the form of needles, columns, plates or scales.

In the invention, organic silver salts in the form of scales are preferable. Also, use can be preferably made of amorphous grains in the form of, for example, short needles having a major axis/minor axis ratio of 5 or less, or cubic, rectangular or potato-shaped grains. These organic silver grains are characterized by showing little fogging in thermal development compared with grains of the long needle form having a major axis/minor axis ratio exceeding 5. Among all, grains having major axis/minor axis ratio of 3 or less are preferable, since these grains contribute to the improvement in the mechanical stability of a coating film. An organic acid silver salt of the scale form is defined as follows herein. Namely, an organic acid silver salt is observed under an electron microscope and the shape of a grain of the organic acid silver salt is approximated a rectangle. The sides of this rectangles are referred to as a, b and c in ascending order (c may be equal to b) and then x is determined using the values a and b as follows.

$$x=b/a$$

In this manner, x's of about 200 grains are determined and the average x is calculated. Thus, an organic acid silver salt fulfilling the relationship x (average)$\geqq$1.5 is referred to as the scale type. Grains fulfilling the relationship 30$\geqq$x (average)$\geqq$1.5 are still preferable and those fulfilling the relationship 15$\geqq$x (average)$\geqq$1.5 are still preferable. By the say, needle type grains show the relationship 1$\leqq$x (average) $\leqq$1.5.

In scale type grains, a can be considered as the thickness of plate grains having a plane made of the sides b and c as the main plane. The average of a preferably ranges from 0.01 $\mu$m to 0.23 $\mu$m and still preferably from 0.1 $\mu$m to 0.23 $\mu$m. the average of c/b preferably ranges from 1 to 6, still preferably from 1.05 to 4, still preferably from 1.1 to 3 and particularly preferably from 1.1 to 2.

It is preferable that the grain size distribution of an organic silver salt is in a monodispersion. The term "monodispersion" means that the percentage of the values calculated by dividing the standard deviations of the minor axis and the major axis respectively by the minor axis and the major axis is preferably 100% or less, still preferably 80% or less and still preferably 50% or less. The form of the organic silver salt may be determined from the scanning electron microscopic image of an organic acid silver salt dispersion. As another method of measuring the monodispersibility, the standard deviation of the volume-weighted average diameter of the organic silver salt may be determined. Namely, The percentage (coefficient of variation) calculated by dividing by the volume-weighted average diameter is preferably 100% or less, still preferably 80% or less and still preferably 50% or less. The measurement can be carried out by, for example, irradiating the organic silver salt dispersed in a liquid with laser beams, determining the coefficient of self-correlation to changes in the fluctuation of scattered beams with the passage of time, and thus determining the grain size (volume-weighted average diameter).

The organic acid silver salts to be used in the invention can be produced and dispersed by applying publicly known methods or the like. For example, reference can be made to JP-A-10-62899, European Patent No. 0803763A1, European Patent No. 0962812A1, JP-A-11-349591, JP-A-2000-7683 and JP-A-2000-72711 as described above as well as Japanese Patent Application 11-348228 to 11-348230, Japanese Patent Application 11-203413, Japanese Patent Application 2000-90093, Japanese Patent Application 2000-195621, Japanese Patent Application 191226, Japanese Patent Application 2000-213813, Japanese Patent Application 2000-214155, Japanese Patent Application 2000-191226 and so on.

When the organic silver salts are dispersed in the coexistence of a photosensitive silver salt, fogging is enhanced and thus the sensitivity is seriously lowered. It is therefore preferable that the organic silver salts are substantially free from any photosensitive silver salt at the dispersion. In the dispersion of the invention, the photosensitive silver salt content in the aqueous dispersion is 1% by mol or less, preferably 0.1% by mol or less per mol of the organic acid silver salts in the dispersion. It is still preferable that no photosensitive silver salt is added positively.

In the invention, it is possible to produce a photosensitive material by mixing an aqueous organic silver salt dispersion with an aqueous photosensitive silver salt dispersion. Although the mixing ratio of the organic silver salts to the photosensitive silver sale may be selected depending on the purpose, the ratio of the photosensitive silver salt to the organic silver salts preferably ranges from 1 to 30% by mol, still preferably from 2 to 20% by mol and still preferably from 3 to 15% by mol. In the mixing step, a method of mixing an aqueous dispersion of 2 or more organic silver salts with an aqueous solution of 2 or more photosensitive silver salt has been favorably employed for controlling the photographic characteristics.

In the invention, the organic silver salts may be used in a desired amount. The total coating dose of silver including also a silver halide preferably ranges from 0.1 to 5.0 g/m$^2$, still preferably from 0.3 to 3.0 g/m$^2$ and still preferably from 0.5 to 2.0 g/m$^2$. To improve the image storage properties, it is preferable that the total coating dose of silver is 1.9 g/m$^2$ or less, still preferably 1.75 g/m$^2$ or less and still preferably 1.6 g/m$^2$ or less. Using a reducing agent which is preferably employed in the invention as will be described hereinafter, a sufficient image density can be achieved even at such a low silver content.

Illustration of Reducing Agent

It is preferable that the photothermographic material according to the invention contains a thermal developer which is a reducing agent for thermal development. This reducing agent may be an arbitrary substance (preferably an organic substance) capable of reducing silver ion into metallic silver. Examples of such reducing agents are cited in JP-A-11-65021, Paragraph Nos. 0043 to 0045 and European Patent No. 0803764A1, p. 7, 1. 34 to p. 18, 1. 12.

As the reducing agent to be used in the invention, so-called hindered phenol type reducing agents having a substituent at the ortho-position of a phenolic hydroxyl group and bisphenol type reducing agents. Compounds represented by the following formula (R) are still preferable.

Formula (R):

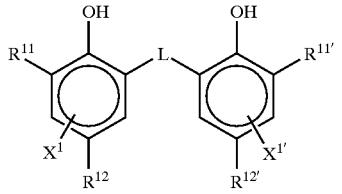

wherein $R^{11}$ and $R^{11'}$ independently represent each an alkyl group having 1 to 20 carbon atoms; $R^{12}$ and $R^{12'}$ independently represent each a hydrogen atom or a substituent capable of attaching to a benzene ring; L represents a —S— group or a —CHR$^{13}$— group (wherein $R^{13}$ represents a hydrogen atom or an alkyl group having 1 to 20 carbon atoms); and $X^1$ and $X^{1'}$ independently represent each a hydrogen atom or a group capable of attaching to a benzene ring as a substituent.

Now, the formula (R) will be illustrated in greater detail.

$R^{11}$ and $R^{11'}$ independently represent each a substituted or unsubstituted alkyl group having 1 to 20 carbon atoms. Although the substituent of the alkyl group is not particularly restricted. preferable examples thereof include an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group, a halogen atom and so on.

$R^{12}$ and $R^{12'}$ independently represent each a hydrogen atom or a substituent capable of attaching to a benzene ring, while $X^1$ and $X^{1'}$ independently represent each a hydrogen atom or a group capable of attaching to a benzene ring as a substituent too. Preferable examples of the substituent capable of attaching to a benzene ring in each case include an alkyl group, an aryl group, a halogen atom, an alkoxy group and an acylamino group.

L represents an —S— group or a —CHR$^{13}$— group. $R^{13}$ represents a hydrogen atom or an alkyl group having 1 to 20 carbon atoms and the alkyl group may have a substituent. Specific examples of the substituent of the unsubstituted alkyl group of $R^{13}$ include 20 carbon atoms); and $X^1$ and $X^{1'}$ independently represent each a hydrogen atom or a group capable of attaching to a benzene ring as a substituent.

Now, the formula (R) will be illustrated in greater detail.

$R^{11}$ and $R^{11'}$ independently represent each a substituted or unsubstituted alkyl group having 1 to 20 carbon atoms. Although the substituent of the alkyl group is not particularly restricted. preferable examples thereof include an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group, a halogen atom and so on.

or a substituent capable of attaching to a benzene ring, while $X^1$ and $X^{1'}$ independently represent each a hydrogen atom or a group capable of attaching to a benzene ring as a substituent too. Preferable examples of the substituent capable of attaching to a benzene ring in each case include an alkyl group, an aryl group, a halogen atom, an alkoxy group and an acylamino group.

L represents an —S— group or a —$CHR^{13}$— group. $R^{13}$ represents a hydrogen atom or an alkyl group having 1 to 20 carbon atoms and the alkyl group may have a substituent. Specific examples of the substituent of the unsubstituted alkyl group of $R^{13}$ include a methyl group, an ethyl group, a propyl group, a butyl group, a heptyl group, an undecyl group, an isopropyl group, a 1-ethylpentyl group, a 2,4,4-trimethylpentyl group and so on. As examples of the substituent of the alkyl group, the groups cited above as the substituent of $R^{11}$ may be cited.

As $R^{11}$ and $R^{11'}$, secondary or tertiary alkyl groups having from 3 to 5 carbon atoms are preferable. Specific examples thereof include an isopropyl group, an isobutyl group, a t-butyl group, a t-amyl group, a t-octyl group, a cyclohexyl group, a cyclopentyl group, a 1-methylcyclohexyl group, a 1-methylcyclopropyl group and so on. Still preferable examples of $R^{11}$ and $R^{11'}$ are tertiary alkyl groups having from 4 to 12 carbon atoms. Among them, a t-butyl group, a t-amyl group and a 1-methylcyclohexyl group are still preferable and a t-butyl group is the most desirable one.

As $R^{12}$ and $R^{12'}$, alkyl groups having from 1 to 20 carbon atoms are preferable. Specific examples thereof include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group and so on. Still preferable examples thereof are a methyl group, an ethyl group, a propyl group, an isopropyl group and a t-butyl group.

$X^1$ and $X^{1'}$ preferably represent each a hydrogen atom, a halogen atom or an alkyl group and a hydrogen atom is still preferable.

It is preferable that L is a —$CHR^{13}$— group.

$R^{13}$ preferably represents a hydrogen atom or an alkyl group having from 1 to 15 carbon atoms. Preferable examples of the alkyl group include a methyl group, an ethyl group, a propyl group, an isopropyl group and a 2,4,4-trimethylpentyl group. It is particularly preferable that $R^{13}$ is a hydrogen atom, a methyl group, an ethyl group, a propyl group or an isopropyl group.

In the case where $R^{13}$ is a hydrogen atom, it is preferable that $R^{12}$ and $R^{12'}$ are each an alkyl group having from 2 to 5 carbon atoms and still preferably an ethyl group or a propyl group and an ethyl group is the most desirable one.

In the case where $R^{13}$ is a primary or secondary alkyl group having from 1 to 8 carbon atoms, it is preferable that $R^{12}$ and $R^{12'}$ are each a methyl group. Still preferable examples of the primary or secondary alkyl group having from 1 to 8 carbon atoms represented by $R^{13}$ include a methyl group, an ethyl group, a propyl group and an isopropyl group and a methyl group, an ethyl group and a propyl group are still preferable therefor.

In the case where $R^{11}$, $R^{11'}$, $R^{12}$ and $R^{12'}$ are each a methyl group, it is preferable that $R^{13}$ is a secondary alkyl group. In this case, examples of the secondary alkyl group represented by $R^{13}$ include an isopropyl group, an isobutyl group and a 1-ethylpentyl group and an isopropyl group is still preferable.

The reducing agent as described above presents different thermal development properties, developed silver color tones and the like depending on the combination of $R^{11}$, $R^{11'}$, $R^{12}$, $R^{12'}$ and $R^{13}$. Since these factors can be controlled by using 2 or more reducing agents together, it is preferable to use a combination of 2 or more reducing agents depending on the purpose in some cases.

Specific examples of the reducing agents to be used in the invention including the compounds represented by the formula (R) are as follows, though the invention is not restricted thereto.

(R-1)

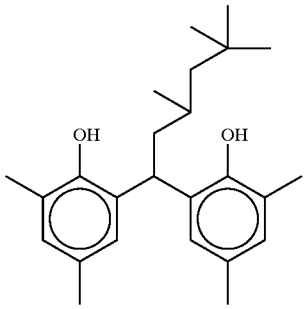

(R-2)

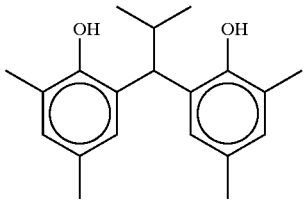

(R-3)

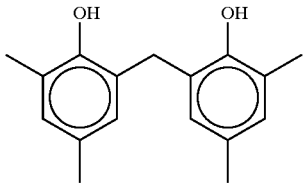

(R-4)

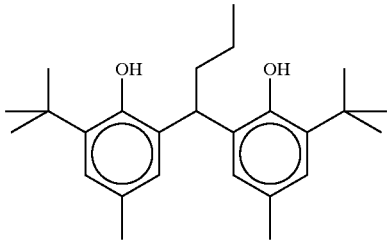

(R-5)

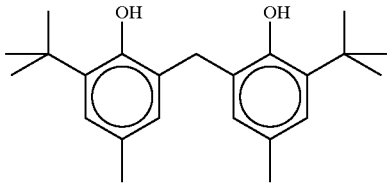

(R-6)

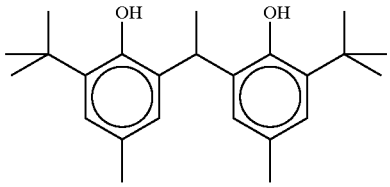

(R-7)

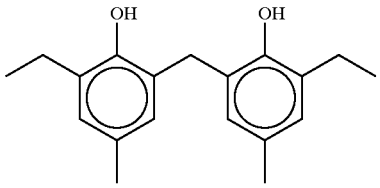

-continued
(R-8)
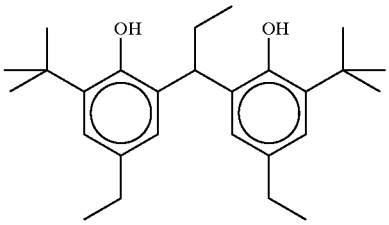
(R-9)
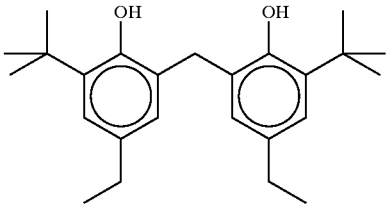
(R-10)
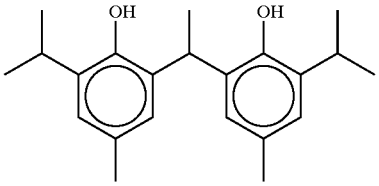
(R-11)
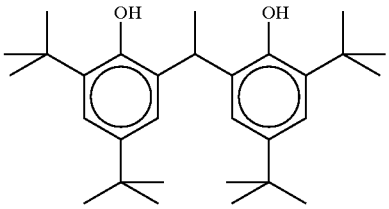
(R-12)
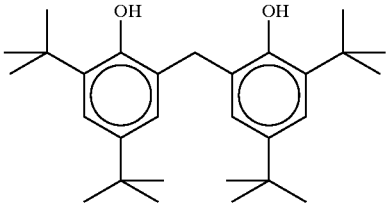
(R-13)
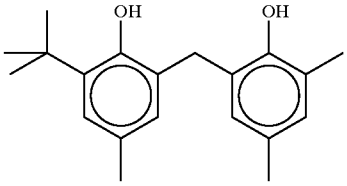
(R-14)
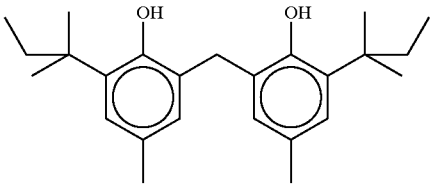
-continued
(R-15)
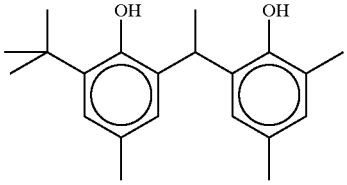
(R-16)
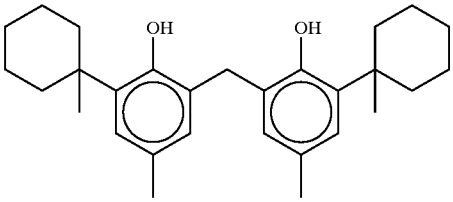
(R-17)
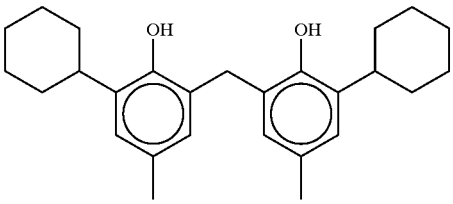
(R-18)
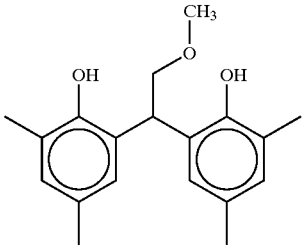
(R-19)
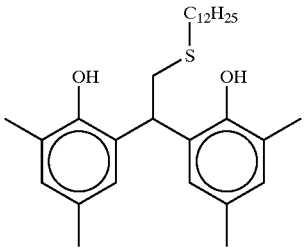
(R-20)
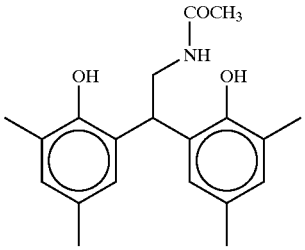
(R-21)
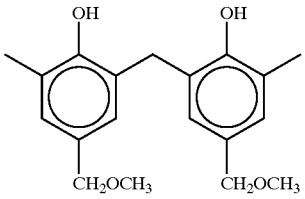

-continued
(R-22)
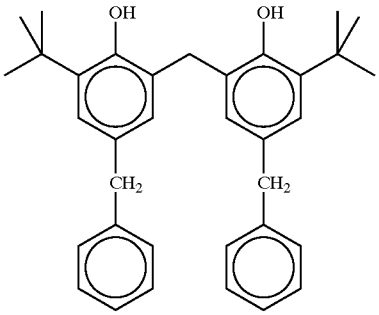
(R-23)
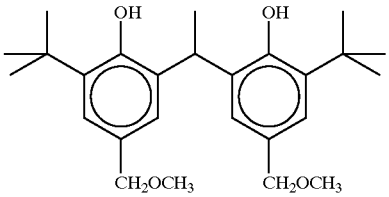
(R-24)
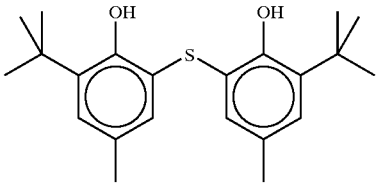
(R-25)
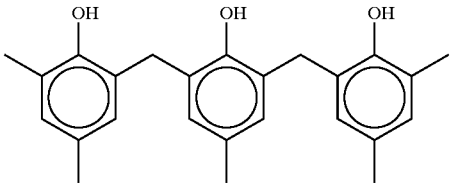
(R-26)
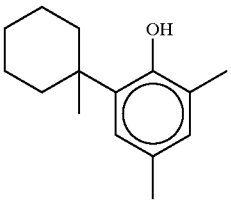
(R-27)
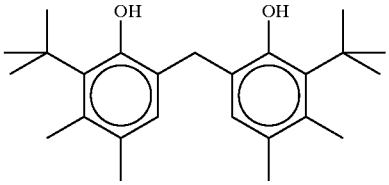
(R-28)
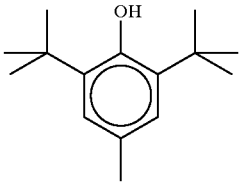
-continued
(R-29)
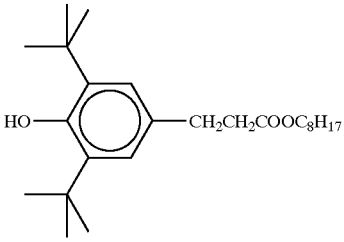
(R-30)
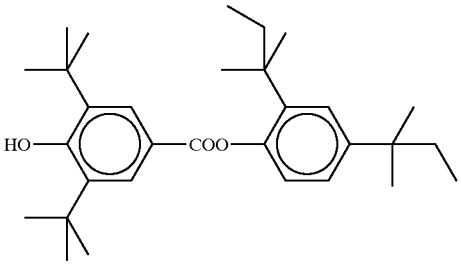
(R-31)
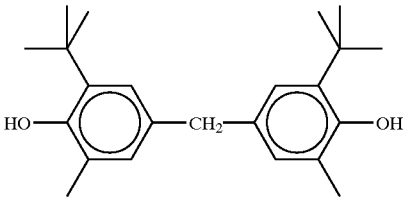
(R-32)
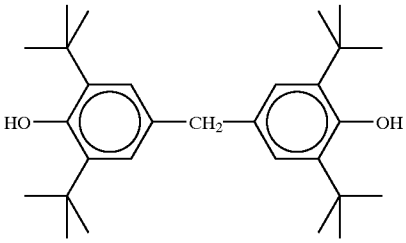
(R-33)
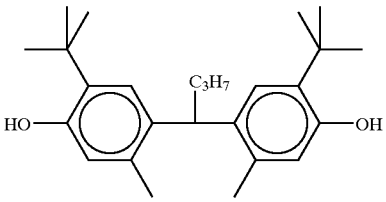
(R-34)
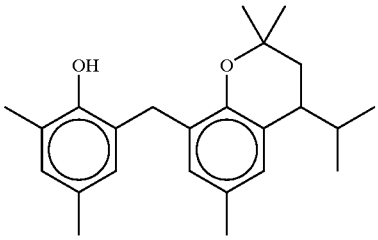
In the invention, the content of the reducing agent preferably ranges from 0.1 to 3.0 g/$m^2$, still preferably from 0.2 to 1.5 g/$m^2$ and still preferably from 0.3 to 1.0 g/$m^2$. It is preferable that the reducing agent is contained in an amount of from 5 to 50% by mol, still preferably from 8 to 30% by mol and still preferably from 10 to 20% by mol, per mol of silver in the face having the image forming layer. It is preferable that the reducing agent is contained in the image forming layer.

The reducing agent may be contained in the coating solution and, in its turn, in the photosensitive material by an arbitrary method, for example, in the form of a solution, an emulsion dispersion or a dispersion of fine solid grains.

The well known emulsion dispersion method is exemplified by a method wherein the reducing agent is dissolved with the use of an auxiliary solvent, for example, an oil such as dibutyl phthalate, tricresyl phosphate, glyceryl triacetate or diethyl phthalate or cyclohexeneone and then an emulsion dispersion is mechanically formed.

The dispersion of fine solid grains may be obtained by, for example, a method wherein a powder of the reducing agent is dispersed in an appropriate solvent such as water with the use of a ball mill, a colloid mill, a vibration mill, a sand mill, a jet mill, a roll mill or ultrasonic wave to thereby give a dispersion of solid. In this case, use may be also made of a protective colloid (for example, polyvinyl alcohol) and a surfactant (for example, an anionic surfactant such as sodium triisopropylnaphthalenesulfonate (a mixture of compounds substituted by 3 isopropyl groups at different positions)). In the above-described mills, it has been a practice to use beads made of zirconia or the like as a dispersion medium. Thus, the obtained dispersion is sometimes contaminated with Zr or the like eluted from the beads. The concentration of the contaminant usually ranges from 1 ppm to 1000 ppm, though it varies depending on the dispersion conditions. In the where the Zr content in the photothermographic material is 0.5 mg or less per gram of silver, there arises no problem in practice.

It is preferable that the aqueous dispersion contains a preservative (for example, sodium salt of benzoisothiazolinone).

In the invention, it is preferable to use the reducing agent in the form of a dispersion of solid.

Illustration of Development Accelerator

In the photothermographic material according to the invention, it is preferable to use as a development accelerator sulfonamide phenol type compounds represented by the formula (A) which are described in JP-A-2000-267222, JP-A-2000-330234 and so on, hindered phenol type compounds represented by the formula (II) which are described in JP-A-2001-92075, hydrazine type compounds represented by the formula (I) which are described in JP-A-10-62895, JP-A-11-15116 and so on and represented by the formula (1) which are represented by Japanese Patent Application 2001-074278, and, in particular, phenol type or naphthol type compounds represented by the formula (2) which are described in JP-A-2001-264929. Such a development accelerator is employed in an amount of from 0.1 to 20% by mol, preferably from 0.5 to 10% by mol and still preferably from 1 to 5% by mol, based on the reducing agent. The development accelerator may be introduced into the photothermographic material in the same manners as in the reducing agent. It is particularly preferable to add the development accelerator in the form of a dispersion of solid or an emulsion dispersion. In case of adding the development accelerator as an emulsion dispersion, it is preferable to add the development accelerator in the form of an emulsion dispersion prepared by dispersing it with the use of a high-boiling solvent being a solid at ordinary temperature with a low-boiling auxiliary solvent, or as a so-called oil-less emulsion dispersion prepared without using any high-boiling solvent.

Among the development accelerators as cited above, it is particularly preferable in the invention to use hydrazine type compounds represented by the formula (1) described in Japanese Patent Application 2001-074278 and the phenol type or naphthol type compounds represented by the formula (2) described in JP-A-2001-264929.

Next, specific examples of the development accelerator preferably employed in the invention will be cited, though the invention is not restricted thereto.

(A-1)

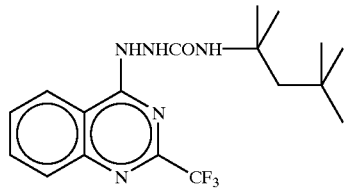

(A-2)

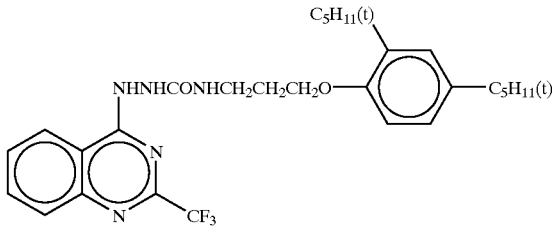

(A-3)

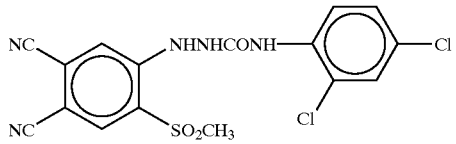

(A-4)

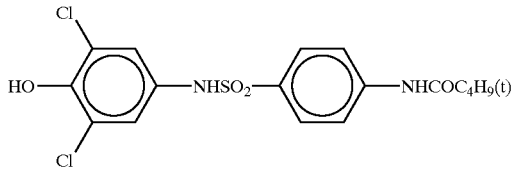

(A-5)

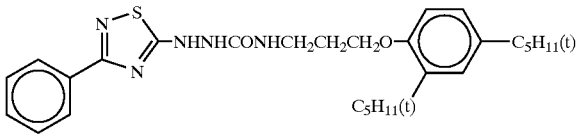

(A-6)

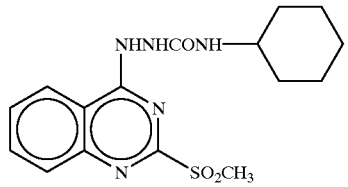

(A-7)

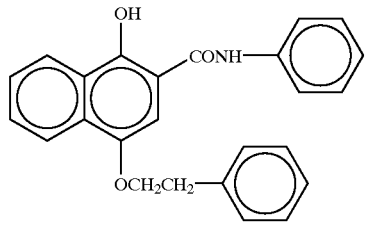

-continued (A-8)

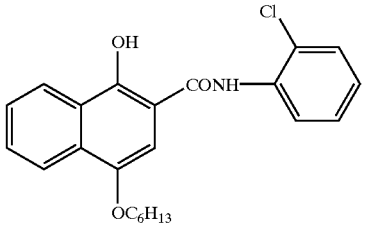

(A-9)

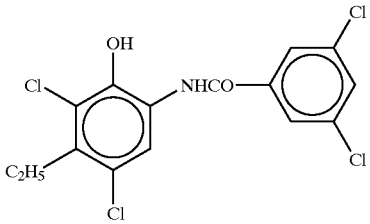

(A-10)

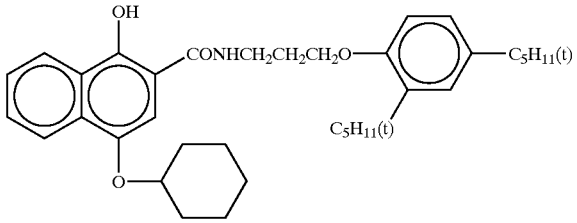

Illustration of Hydrogen Bond Compound

In the case where the reducing agent in the invention has an aromatic hydroxyl group (—OH), in particular, in the case of the bisphenols as described above, it is preferable to use together a non-reducing compound having a group capable of forming a hydrogen bond with the above group. Examples of the group capable of forming a hydrogen bond with a hydroxyl group or an amino group include a phosphoryl group, a sulfoxide group, a sulfonyl group, a carbonyl group, an amide group, an ester group, an urethane group, an ureido group, a tertiary amino group, a nitrogen-containing aromatic group and so on. Among all, it is preferable to use a compound having a phosphoryl group, a sulfoxide group, an amide group (which has no >N—H group and is blocked as >N—Ra (wherein Ra is a substituent other than H)), an urethane group (which has no >N—H group and is blocked as >N—Ra (wherein Ra is a substituent other than H)) or an ureido group (which has no >N—H group and is blocked as >N—Ra (wherein Ra is a substituent other than H)).

Examples of the hydrogen bond compound particularly preferable in the invention are the compounds represented by the following formula (D).

Formula (D):

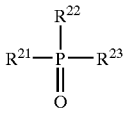

In the formula (D), $R^{21}$ to $R^{23}$ independently represent each an alkyl group, an aryl group, an alkoxy group, an aryloxy group, an amino group or a heterocyclic group which may be either unsubstituted or substituted. In the case where $R^{21}$ to $R^{23}$ have substituents, examples of the substituents include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group and so on. Preferable examples of the substituents include an alkyl group and an aryl group such as a methyl group, an ethyl group, an isopropyl group, a t-butyl group, a t-octyl group, a phenyl group, a 4-alkoxyphenyl group and a 4-acyloxyphenyl group.

Specific examples of the alkyl groups represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, a 2-phenoxypropyl group and so on. Examples of the aryl group include a phenyl group, a cresyl group, a xylyl group, a naphthyl group, a 4-t-butylphenyl group, a 4-t-octylphenyl group, a 4-anisidyl group, a 3,5-dichlorophenyl group and so on. Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group and so on. Examples of the aryloxy group include a phenoxy group, a cresyloxy group, an isopropylphenoxy group, a 4-t-butylphenoxy group, a naphthoxy group, a biphenyloxy group and so on. Examples of the amino group include a dimethylamino group, a diethylamino group, a dibutylamino group, a dioctylamino group, an N-methyl-N-hexylamino group, a dicyclohexylamino group, a diphenylamino group, an N-methyl-N-phenylamino group and so on.

Preferable examples of $R^{21}$ to $R^{23}$ include an alkyl group, an aryl group, an alkoxy group and an aryloxy group. From the viewpoint of the effects of the invention, it is preferable that at least one of $R^{21}$ to $R^{23}$ is an alkyl group or an aryl group. It is still preferable that at least two of $R^{21}$ to $R^{23}$ are alkyl groups or aryl groups. It is also preferable that $R^{21}$ to $R^{23}$ are all the same, since such a compound can be obtained less expensively.

Next, specific examples of the hydrogen bond compound in the invention including the compounds of the formula (D) will be presented, though the invention is not restricted thereto.

(D-1)

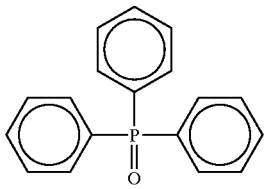

(D-2)

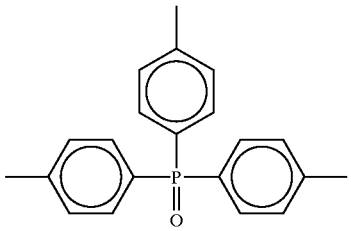

-continued
(D-3)
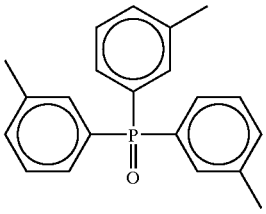
(D-4)
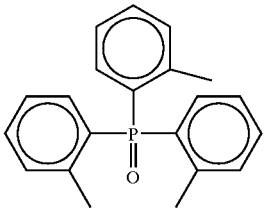
(D-5)
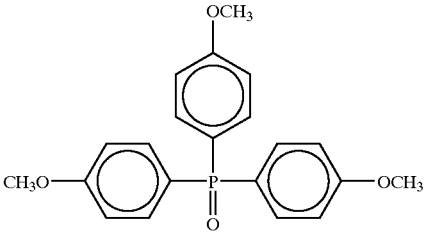
(D-6)
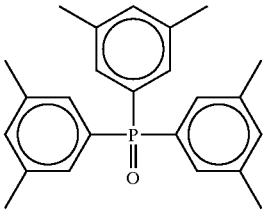
(D-7)
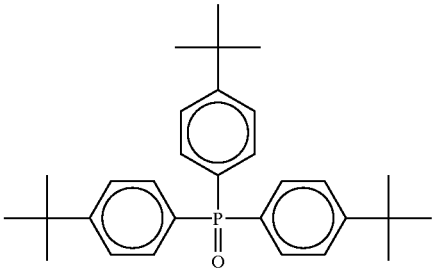
(D-8)
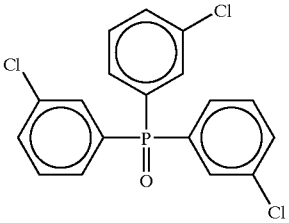
(D-9)
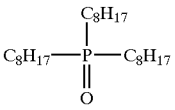
-continued
(D-10)
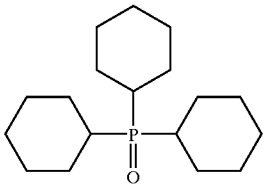
(D-11)
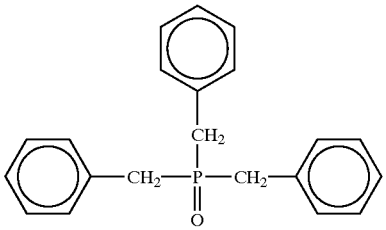
(D-12)
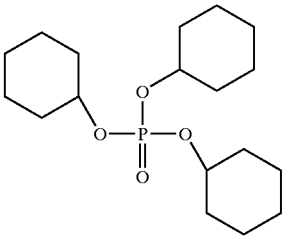
(D-13)
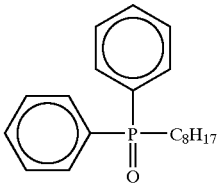
(D-14)
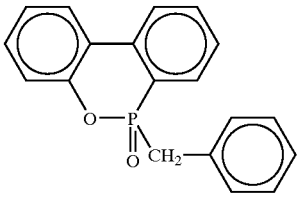
(D-15)
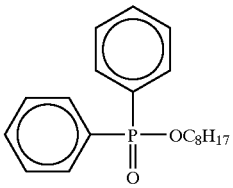
(D-16)
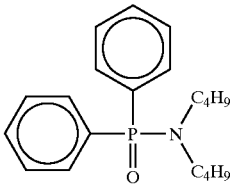

-continued (D-17)

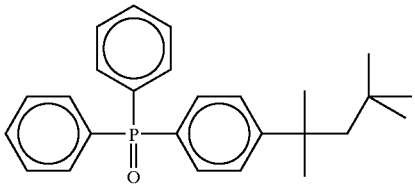

(D-18)

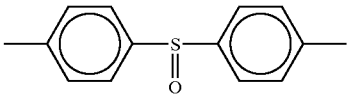

(D-19)

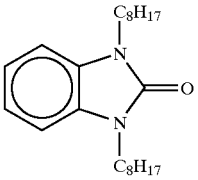

(D-20)

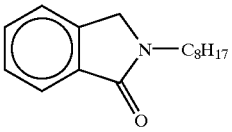

(D-21)

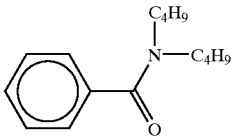

Specific examples of the hydrogen bond compound other than those cited above include the compounds described in European Patent No. 1096310, Japanese Patent Application 2000-270498 and Japanese Patent Application 2001-124796.

Similar to the reducing agent, the compound of the formula (D) to be used in the invention can be added in the form of a solution, an emulsion dispersion or a dispersion of fine solid grains and employed in the photothermographic material. It is preferable to use the compound in the form of a solid dispersion. In the state of a solution, the compound of the formula (D) forms a hydrogen bond complex with a compound having a phenolic hydroxyl group or an amino group. In some combinations of the reducing agent with the compound of the formula (D), therefore, such a complex can be isolated as crystals. It is particularly preferable to use the thus isolated crystalline powder as a dispersion of fine solid grains so as to achieve a stable performance. Also, use may be preferably made of a method wherein the reducing agent and the compound of the formula (D) are mixed together in a powdery state and then a complex is formed in the step of dispersion with a sand grinder mill or the like by using an appropriate dispersant.

It is preferable that the compound of the formula (D) is used in an amount of from 1 to 200% by mol, still preferably from 10 to 150% by mol and still preferably from 20 to 100% by mol based on the reducing agent.

Illustration of Silver Halide

The photosensitive silver halide to be used in the invention is not particularly restricted in halogen composition. Namely, use can be made of silver chloride, silver chlorobromide, silver bromide, silver iodobromide, silver iodochloride or silver iodide. Among all, silver bromide and silver iodobromide are preferable therefor. The halogen composition in grains may be either uniform or varied stepwise or continuously. Silver halide grains having a core/shell structure can be preferably employed too. A 2- to 5-layered structure is preferable. It is still preferable to use core/shell grains of a 2- to 4-layered structure. Also, use can be preferably made of a technique of localizing silver bromide or silver iodide on the surface of silver chloride, silver bromide or silver chlorobromide grains.

Methods of forming photosensitive silver halide have been well known in the art. For example, use can be made of the methods reported in Research Disclosure, No. 17029, June, 1978 and U.S. Pat. No. 3,700,458. More specifically speaking, a silver donating compound and a halogen donating compound are added to a solution of gelatin or other polymers to give a photosensitive silver halide which is then mixed with an organic silver salt. It is also preferable to employ the methods described in JP-A-11-119374, Paragraph Nos. 0217 to 0224, JP-A-11-352627 and JP-A-2000-347335.

To regulate clouding after the image formation, it is preferable to employ a small-sized photosensitive silver halide grains. More specifically speaking, it is preferable that the grain size is 0.20 $\mu$m or less, still preferably from 0.01 $\mu$m to 0.15 $\mu$m and still preferably from 0.02 $\mu$m to 0.12 $\mu$m. The term "grain size" as used herein means the diameter of a circular image having the same area as the projected area of a silver halide grain (the projected area of the main plane in the case of a plane grain).

Concerning the shape, the silver halide grains may be cubic grains, octahedral grains, planar grains, spherical grains, column-type grains, potato-like grains or the like. In the invention, cubic grains are particularly preferable. Also, use can be preferably made of silver halide grains having rounded edges. Although the Plane index (Miller index) of the outer surface of the photosensitive silver halide grains is not particularly restricted, it is preferable to have a high ratio of the [100] plane which shows a high spectral sensitization efficiency upon the adsorption of a spectral sensitizing dye. The ratio preferably amounts to 50% or more, still preferably 65% or more and still preferably 80% or more. The ratio of the plane with a Miller index of [100] can be determined by the method reported by T. Tani: J. Imaging Sci., 29, 165 (1985) with the use of the adsorption dependency between the [111] plane and the [100] plane.

In the invention, silver halide grains having a hexacyano-metal complex located on the uppermost surface of the grains. Examples of the hexacyano-metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, $[Re(CN)_6]^{3-}$ and so on. In the invention, it is preferable to use a hexacyano-iron complex.

Since a hexacyano-metal complex occurs in the form of an ion in an aqueous solution, its counter cation is not so important. However, it is preferable to employ an alkali metal such as ion a sodium ion, a potassium ion, a rubidium ion or a cesium ion, an ammonium ion or an alkylammonium ion (for example, a tetramethylammonium ion, a tetraethylammonium ion, a tetrapropylammonium ion or a tetra (n-butyl) ammonium ion) which are highly miscible with water and suitable for the precipitation of the silver halide emulsion.

The hexacyano-metal complex can be added as a mixture with water, a mixture of water with an appropriate water-miscible organic solvent (for example, alcohols, ethers, glycols, ketones, esters, amides and the like) or gelatin.

The content of the hexacyano-metal complex preferably ranges from $1\times10^{-5}$ mol to $1\times10^{-2}$ mol, still preferably from $1\times10^{-4}$ mol to $1\times10^{-3}$ mol.

To localize the hexacyano-metal complex on the outermost layer of the silver halide grains, the hexacyano-metal complex is directly added between the completion of the addition of an aqueous silver nitrate solution employed for forming the grains and the chemical sensitization step of performing chalgogen sensitization such as sulfur sensitization, selenium sensitization and tellurium sensitization or precise metal sensitization such as gold sensitization, during the water washing step, during the dispersion step or before the chemical sensitization step. To prevent the fine silver halide grains from development, it is preferable to quickly add the hexacyano-metal complex after the formation of the grains. Thus, it is preferable to add the hexacyano-metal complex before the completion of the feeding step.

The addition of the hexacyano-metal complex may be started after adding 96% by weight of silver nitrate which is added for forming the grains. It is preferable to add the hexacyano-metal complex after adding 98% by weight, still preferably 99% by weight, of silver nitrate.

By adding the hexacyano-metal complex after adding the aqueous silver nitrate solution and immediately before the completion of the grain formation, the hexacyano-metal complex can be adsorbed on the outermost surface of the silver halide grains and the major portion of the hexacyano-metal complex forms a hardly soluble salt with the silver ion on the grain surface. Since the thus formed hexacyano-iron (II) silver salt is more hardly soluble than AgI, the re-dissolution due to the fine grains can be prevented. Thus, it becomes possible to produce fine silver halide grains having a smaller grain size.

The photosensitive silver halide grains according to the invention can contain a metal or a metal complex selected from the group 8 to the group 10 in the periodic table (showing from 1 to 18 groups). Preferable examples of the metal or the central metal of the metal complex selected from the group 8 to the group 10 in the periodic table include rhodium, ruthenium and iridium. Either one of these metal complexes or 2 or more complexes of the same or different metal species may be used. The preferable content thereof ranges from $1\times10^{-9}$ mol to $1\times10^{-3}$ mol per mol of silver. These heavy metals and metal complexes and methods of adding the same are described in JP-A-7-225449, JP-A-11-65021, Paragraph Nos. 0018 to 0024 and JP-A-11-119374, Paragraph Nos. 0227 to 0240.

Furthermore, metal atoms (for example, $[Fe(CN)_6]^{4-}$) which can be contained in the silver halide grains according to the invention, a method of desalting the silver halide emulsion and the chemical sensitization method are described in JP-A-11-84574, Paragraph Nos. 0046 to 0050, JP-A-11-65021, Paragraph Nos. 0025 to 0031 and JP-A-11-119374, Paragraph Nos. 0242 to 0250.

As the gelatin to be contained in the photosensitive silver halide emulsion in the invention, various gelatins can be employed. It is necessary to maintain a favorable dispersion state of the photosensitive silver halide emulsion in the organic silver salt-containing coating solution. It is preferable to use a gelatin having a molecular weight of from 10,000 to 1,000,000. It is also preferable to phthal-treat a substituent of the gelatin. Although the gelatin may be added either in the step of grain formation or after the desalting, it is preferable to use it in the step of grain formation.

As a sensitizing dye applicable in the invention, it is advantageous to select a sensitizing dye which can spectrally sensitize the silver halide grains within a desired wavelength region when adsorbed on the silver halide grains and has a spectral sensitivity appropriate for the spectral characteristics of the exposure light source. Concerning sensitizing dyes and methods of adding the same, reference can be made of JP-A-11-65021, Paragraph Nos. 0103 to 0109, the compounds represented by the formula (II) in JP-A-10-186572, the dyes represented by the formula (I) and Paragraph No. 0106 in JP-A-11-119374, U.S. Pat. No. 5,510,236, the dye described in Example 5 of U.S. Pat. No. 3,871,887, JP-A-2-96131, the dye disclosed in JP-A-59-48753, European Patent No. 0803764A1, p. 19, 1. 38 to p. 20, 1.35, JP-A-2001-272747, JP-A-2001-290238, JP-A-2002-23306 and so on. Either one of these sensitizing dyes or a combination of 2 or more thereof may be used. In the invention, it is preferable that the sensitizing dye is added to the silver halide emulsion between the completion of the desalting step and the coating. It is still preferable to add the sensitizing dye between the completion of the desalting and the completion of the chemical aging.

In the invention, the sensitizing dye may be added in a desired amount depending on the sensitivity and the fogging performance. It is preferable to add the sensitizing dye in an amount of from $10^{-6}$ to 1 mol. still preferably from $10^{-4}$ to $10^{-1}$ mol per mol of the silver halide in the photosensitive layer.

In the invention, use can be made of a strong color sensitizer to improve the spectral sensitization efficiency. Examples of the strong color sensitizer include the compounds described in European Patent No. 587,338, U.S. Pat. Nos. 3,877,943, 4,873,184, JP-A-5-341432, JP-A-11-109547, JP-A-10-111543 and so on.

It is preferable that the photosensitive silver halide grains in the invention are chemically sensitized by the sulfur sensitization method, the selenium sensitization method or the tellurium sensitization method. As the compound preferably employed in the sulfur sensitization method, the selenium sensitization method or the tellurium sensitization method, use can be made of publicly known compounds such as the compounds described in JP-A-7-128768 and so on. In the invention, the tellurium sensitization is preferably and the compounds described in JP-A-11-65021, Paragraph No. 0030 and the compounds represented by the formulae (II), (III) and (IV) in JP-A-5-313284 are still preferable.

It is preferable that the photosensitive silver halide grains in the invention are chemically sensitized by the gold sensitization method which is either combined with the chalcogen sensitization or employed alone. As the gold sensitizer, a compound having a gold valency of +1 or +3 is preferable. Use can be preferably made of gold compounds which are usually employed as a gold sensitizer. Typical examples thereof include gold chloride, gold bromide, sodium chloroaurate, potassium chloroaurate, auric trichloride, potassium auric thiocyanate, potassium iosoaurate, tetracyano auric acid, ammonium aurothiocyanate, pyridyltrichlorogold and the like. Moreover, the gold sensitizers described in U.S. Pat. No. 5,858,637 and Japanese Patent Application 2001-79450 may be preferably employed.

In the invention, the chemical sensitization can be performed at any point between the completion of the grain formation and the coating. Namely, it can be carried out after the desalting and (1) before the spectral sensitization, (2) simultaneously with the spectral sensitization, (3) after the spectral sensitization, (4) immediately before coating, etc.

Although the amount of the sulfur, selenium or tellurium sensitizer to be used in the invention varies depending on the silver halide grains employed, the chemical aging conditions and so on, it is employed in an amount of from $10^{-8}$ to $10^{-2}$ mol, preferably from $10^{-7}$ to $10^{-3}$ mol per mol of the silver halide.

The amount of the gold sensitizer to be added varies depending on various conditions. In general, it is used in an amount of from $10^{-7}$ mol to $10^{-3}$ mol, preferably from $10^{-6}$ mol to $5\times10^{-4}$ mol per mol of the silver halide.

The chemical sensitization condition in the invention are not particularly restricted. Namely, the pH ranges from 5 to 8, the pAg ranges from 6 toll and the temperature ranges from about 40 to 95° C.

A thiosulfonic acid compound may be added to the silver halide emulsion to be used in the invention in accordance with the method reported in European Patent No. 293,917.

It is preferable that the photosensitive silver halide grains in the invention are sensitized by reduction with the use of a reducing agent. As the compound specifically used in the reducing sensitization, it is preferable to use ascorbic acid or thiourea dioxide. In addition, it is also preferable to use stannous chloride, aminoiminomethanesulfonic acid, a hydrazine derivative, a borane compound, a silane compound, a polyamine compound and so on. The reducing sensitizer may be added at an arbitrary step during the production of the photosensitive emulsion, i.e., between the development of crystals and the preparation step immediately before the coating. It is preferable to carry out the reducing sensitization while maintaining the pH value at 7 or above and the pAg at 8.3 or below. It is also preferable to carry out the reducing sensitization by introducing a single addition moiety of silver ion during the formation of the grains.

It is preferable that the photosensitive silver halide emulsion in the invention contains an FFD sensitizer (fragmentable electron donating sensitizer) as a compound capable of generating 2 electrons per photon. Preferable examples of the FFD sensitizer include the compounds described in U.S. Pat. Nos. 5,747,235, 5,747,236, 6,054,260, 5,994,051 and Japanese Patent Application 2001-86161. The FFD sensitizer may be preferably added at an arbitrary step between the developments of the crystals to the preparation step immediately before the coating. Although the amount of the FFD sensitizer to be added varies depending on various conditions, it is generally added in an amount of from $10^{-7}$ mol to $10^{-1}$ mol, preferably from $10^{-6}$ mol to $5\times10^{-2}$ mol per mol of the silver halide.

The photosensitive material to be used in the invention may contain either one photosensitive silver halide emulsion or a combination of 2 or more thereof (namely, those different from each other in average grain size, those different from each other in halogen composition, those different from each other in crystalline properties, or those different from each other in chemical sensitization conditions). The tone can be controlled by using a plural species of photosensitive silver halides having different sensitivities. As concerning techniques, reference may be made of JP-A-57-119341, JP-A-53-106125, JP-A-47-3929, JP-A-48-55730, JP-A-46-5187, JP-A-50-73627, JP-A-57-150841 and so on. It is preferable that the sensitivity difference among the emulsions is 0.2 logE or higher.

The content of the photosensitive silver halide expressed in the coating dose of silver per $m^2$ of the photosensitive material preferably ranges from 0.03 to 0.6 $g/m^2$, still preferably from 0.05 to 0.4 $g/m^2$ and most desirably from 0.07 to 0.3 $g/m^2$. Per mol of the organic silver salt, it is preferable to use the photosensitive silver halide in an amount of from 0.01 mol to 0.5 mol, still preferably from 0.02 mol to 0.3 mol and still preferably from 0.03 mol to 0.2 mol.

Concerning the method and conditions of mixing the photosensitive silver halide and the organic silver salts which have been separately prepared, the silver halide grains and the organic silver salts each having been prepared may be mixed with the use of a high-speed stirrer, a ball mill, a sand mill, a colloid mill, a vibration mill, a homogenizer or the like. Alternatively, the photosensitive silver halide may be added at any point during the preparation of the organic silver salts to thereby give the organic silver salts. The mixing method is not particularly restricted, so long as the effects of the invention can be sufficiently achieved. To control photographic characteristics, it is a preferable method to mix an aqueous dispersion of 2 or more organic salts with an aqueous dispersion of 2 or more photosensitive silver salts.

In the invention, it is preferable to add the silver halide to the coating solution for the image forming layer at a point of 180 minutes before to immediately before the coating, preferably 60 minutes before to 10 seconds before the coating. The mixing method and the mixing conditions are not particularly restricted, so long as the effects of the invention can be sufficiently achieved. As a specific mixing method, use can be made of a method of mixing in a tank while controlling the average retention time to a desired level calculated based on the addition flow rate and the feeding rate to the coater, or the method using a static mixer as described in N. Harnby, M. F. Edwards and A. W. Nienow, translated by Koji Takahashi "Ekitai Kongo Gijutsu" (Nikkan Kogyo Shinbun, 1989), Chapter 8 or the like.

Illustration of Binder

As the binder in the organic silver salt-containing layer of the photosensitive material according to the invention, use may be made of any polymer. Appropriate binders are transparent or translucent and generally colorless natural resins, polymers and copolymers, synthetic resins, polymers and copolymers and other film-forming media. Examples thereof include gelatins, rubbers, poly(vinyl alcohol)s, hydroxyethylcelluloses, cellulose acetates, cellulose acetate butyrates, poly(vinyl pyrrolidone)s, casein, starch, poly (acrylic acid)s, poly(methylmethacrylic acid)s, poly(vinyl chloride)s, poly (methacrylic acid) s, styrene-maleic anhydride copolymers, styrene-acrylonitrile copolymers, styrene-butadiene copolymers, poly(vinylacetal)s (for example, poly(vinylformal) and poly(vinylbutyral)), poly (ester)s poly(urethane)s, phenoxy resins, poly(vinylidene chloride)s, poly(epoxide)s, poly(carbonate)s, poly(vinyl acetate)s, poly (olefin) s, cellulose esters and poly(amide)s. The binder may be formed by the coating method using water, an organic solvent or an emulsion.

It is preferable in the invention that the binder usable together in the organic acid salt-containing layer has a glass transition temperature of from 0° C. to 80° C. (hereinafter sometimes referred to as a "high Tg binder"), still preferably from 10° C. to 70° C. and still preferably from 15° C. to 60° C.

Tg is calculated herein in accordance with the following formula.

$$1/Tg=\Sigma(Xi/Tgi)$$

In the above formula, a polymer is referred to as being composed of n monomer components (from i=1 to i=n) copolymerized with each other. Xi stands for the weight ratio of the No.i monomer ($\Sigma Xi=1$). Tgi stands for the glass transition temperature (the absolute temperature) of a homopolymer of the No.i monomer. $\Sigma$ means the sum of i=1 to i=n. As the glass transition temperature (Tgi) of the homopolymer of each monomer, use is made of the data reported in Polymer Handbook (3rd Edition) (J. Brandrup, E. H. Immergut, (Wiley-Interscience, 1989)).

If needed, a combination of 2 or more binders may be used. It is also possible to combine a binder having a glass transition temperature of 20° C. or above with another binder having a glass transition temperature of lower than 20° C. In case of using a blend of 2 or more polymers having different Tgs, it is preferable that the weight-average Tg falls within the range as specified above.

It is preferable in the invention to form the organic silver salt-containing layer by using a coating solution containing water in an amount of 30% by weight or more of the solvent, coating it and drying to thereby form a film.

In the invention, the performance is improved in the case where the organic silver salt-containing layer is formed by using a coating solution containing water in an amount of 30% by weight or more of the solvent, coating it and drying to thereby form a film, particularly in the case where the binder in the organic silver salt-containing layer is soluble or dispersible in an aqueous solvent (a water solvent), and particularly in the case where the binder comprises a polymer latex having an equilibrated water content at 25° C. and 60%RH of 2% by weight or less. In the most desirable embodiment, the binder is prepared so as to give an ion conductivity of 2.5 mS/cm or less. Such preparation can be performed by, for example, synthesizing a polymer and then purifying it with the use of a membrane having a separation function.

The aqueous solvent in which the above-described polymer is soluble or dispersible means water or a mixture of water with 70% by weight or less of a water-miscible organic solvent. Examples of the water-miscible organic solvent include alcohols such as methyl alcohol, ethyl alcohol and propyl alcohol, cellosolves such as methyl cellosolve, ethyl cellosolve and butyl cellosolve, ethyl acetate, dimethylformamide and so on.

The term "aqueous solvent" is also applied to a system in which a polymer is not thermodynamically dissolved but exists in a so-called dispersed state.

The "equilibrated water content at 25° C. and 60%RH" can be expressed as follows using the polymer weight W1 under the conditioned equilibrium at 25° C. and 60%RH and the polymer weight W0 in the absolutely dry state.

$$\text{Equilibrated water content at } 25^\circ \text{ C. and } 60\%\text{RH} = [(W1 - W0)/W0] \times 100 (\%\text{ by weight})$$

Concerning the definition and measurement method of water content, reference can be made to, for example, Kobunshi Kogaku Koza 14, Kobunshi Zairyo Shiken-ho (ed. by The Society of Polymer Science Japan, Chijin Shokann).

It is preferable in the invention that the binder polymer has an equilibrated water content at 25° C. and 60%RH of 2% by weight or less, still preferably from 0.01% by weight to 1.5% by weight and still preferably from 0.02% by weight to 1% by weight.

In the present invention, a polymer dispersible in an aqueous solvent is particularly preferable. As examples of the dispersed state, a latex in which fine grains of a water-insoluble hydrophobic polymer are dispersed, a dispersion wherein a polymer is dispersed as individual molecules or forming a micelle, and the like may be cited. It is still preferable that grains are dispersed to form a latex. The average grain size of the dispersed grains ranges from 1 to 50000 nm, preferably from 5 to 1000 nm, still preferably from 10 to 500 nm and still preferably from 50 to 200 nm. The grain size distribution of the dispersed grains is not particularly restricted. Namely, either a wide grain size distribution or a monodispersion-type grain size distribution may be employed. Also, it is a favorable method to use a mixture of 2 or more dispersions each having a monodispersion type grain size distribution so as to control the physical properties of the coating solution.

As preferable embodiments of the polymer dispersible in an aqueous solvent in the invention, use may be made of hydrophobic polymers such as acrylic polymers, poly (ester) s, rubbers (for example, SBR resin), poly(urethane)s, poly (vinyl chloride)s, poly(vinyl acetate)s, poly(vinylidene chloride)s and poly(olefin)s. Such a polymer may be either linear, branched or crosslinked. Moreover, use may be made of either a so-called homopolymer formed by polymerizing a single monomer or a copolymer formed by polymerizing 2 or more monomers. In the case of a copolymer, use may be made of either a random copolymer or a block copolymer. The number-average molecular weight of such a polymer ranges from 5000 to 1000000, preferably from 10000 to 200000. A polymer having an excessively small molecular weight results in only an insufficient mechanical strength of the emulsion layer. On the other hand, it is also undesirable to use a polymer having an excessively large molecular weight, since the film-forming properties are worsened in this case. A crosslinkable polymer latex is particularly preferably employed.

Specific Examples of Latex

Specific examples of the preferable polymer latex are as follows which are shown with the use of starting monomers. The values given parentheses are expressed in % by weight and molecular weights are number-average molecular weight. Polymers formed by using polyfunctional monomers are indicated as "crosslinkable" without showing molecular weight, since the idea of molecular weight cannot be applied to these polymers forming a crosslinked structure. Tg means glass transition temperature.

P-1; -MMA(70)-EA(27)-MAA(3) latex (molecular weight 37000, Tg 61° C.)

P-2; -MMA(70)-2EHA(20)-St(5)-AA(5) latex (molecular weight 40000, Tg 59° C.)

P-3; -St(50)-Bu(47)-MAA(3) latex (crosslinkable, Tg −17° C.)

P-4; -St(68)-Bu(29)-AA(3) latex (crosslinkable, Tg 17° C.)

P-5; -St(71)-Bu(26)-AA(3) latex (crosslinkable, Tg 24° C.)

P-6; -St(70)-Bu(27)-IA(3) latex (crosslinkable)

P-7; -St(75)-Bu(24)-AA(1) latex (crosslinkable, Tg 29° C.)

P-8; -St(60)-Bu(35)-DVB(3)-MAA(2) latex (crosslinkable)

P-9; -St(70)-Bu(25)-DVB(2)-AA(3) latex (crosslinkable)

P-10; -VC(50)-MMA(20)-EA(20)-AN(5)-AA(5) latex (molecular weight 80000)

P-11; -VDC(85)-MMA(5)-EA(5)-MAA(5) latex (molecular weight 67000)

P-12; -Et(90)-MAA(10) latex (molecular weight 12000)

P-13; -St(70)-2EHA(27)-AA(3) latex (molecular weight 130000, Tg 43° C.)

P-14; -MMA(63)-EA(35)-AA(2) latex (molecular weight 33000, Tg 47° C.)

P-15; -St(70.5)-Bu(26.5)-AA(3) latex (crosslinkable, Tg 23° C.)

P-16; -St(69.5)-Bu(27.5)-AA(3) latex (crosslinkable, Tg 20.5° C.)

The abbreviations employed in the above structures respectively stand for the following monomers: MMA: methyl methacrylate, EA: ethyl acrylate, MAA: methacrylic acid, 2EA: 2-ethylhexyl acrylate, St: styrene, Bu: butadiene, AA: acrylic acid, DVA: divinylbenzene, VC: vinyl chloride, AN: acrylonitrile, VDC: vinylidene chloride, Et: ethylene, and IA: itaconic acid.

The polymer latexes cited above are commercially available and use can be made of the following polymers.

Examples of the acrylic polymers include Cevians A-4635, 4718, 4601 (each manufactured by Daicel Chemical Industries, Ltd.), Nipols Lx811, 814, 821, 820 and 857 (each manufactured by Zeon Corporation) and so on; examples of the poly(ester)s include FINETEXS ES65, 611, 675 a d850 (each manufactured by Dainippon Ink and Chemicals, Inc.), WD-size WMS (manufactured by Eastman Chemical Co.) and so on the; examples of the poly(urethane)s include HYDRANS AP10, 20, 30 and 40 (each manufactured by Dainippon Ink and Chemicals, Inc.) and so on; examples of the rubbers include LACSTARS 7310K, 3307B 4700H an d7132 C (each manufactured by Dainippon Ink and Chemicals, Inc.), Nipols Lx416, 410, 438C and G676 (each manufactured by Zeon Corporation) and so on; examples of the poly(vinyl chloride)s include G351 and G576 (each manufactured by Zeon Corporation); examples of the poly (vinylidene chloride)s include L502 and L513 (each manufactured by Asahi Kasei Corporation) and so on; and examples of the poly(olefin)s include Chemipearls S120 and SA100 (each manufactured by Mitsui Petrochemical Industries, Ltd.).

One of these polymer latexes may be used alone. Alternatively, a blend of 2 or more of them may be used if needed.

Preferable Latex

As the polymer latex to be used in the invention, a styrene-butadiene copolymer latex is particularly preferable. The weight ratio of the styrene monomer unit to the butadiene monomer unit in the styrene-butadiene copolymer preferably ranges from 40:60 to 95:5. It is also preferable that the styrene monomer unit and the butadiene monomer unit amount to 60 to 99% by weight in the styrene-butadiene copolymer. Moreover, it is preferable that the polymer latex of the invention contains from 1 to 6% by weight, still preferably from 2 to 5% by weight, of acrylic acid or methacrylic acid based on the sum of styrene and butadiene. It is preferable that the polymer latex of the invention contains acrylic acid.

Preferable examples of the styrene-butadiene-(meth) acrylic acid copolymer latex to be used in the invention include P-3 to P-8 and P-15 as cited above, commercially available products LACSTARS 3307B and 7132C, Nipol Lx416 and so on.

The organic silver salt-containing layer of the photosensitive material according to the invention may further contain, if needed, a hydrophilic polymer such as gelatin, polyvinyl alcohol, methylcellulose, hydroxypropylcellulose or carboxymethylcellulose. It is preferable that the content of such a hydrophilic polymer is 30% by weight or less, still preferably 20% by weight or less, based on the total binder content in the organic silver salt-containing layer.

It is preferable that the organic silver salt-containing layer (i.e., the image forming layer) of the photosensitive material according to the invention is formed by using a polymer latex. The content of the binder in the e organic silver salt-containing layer ranges from 1/10 to 10/1 (expressed in the weight ratio of total binder/organic silver salt), preferably from 1/3 to 5/1 and still preferably from 1/1 to 3/1.

The organic silver salt-containing layer usually serves as a photosensitive layer (an emulsion layer) containing a photosensitive silver halide. In such a case, the weight ratio of total binder/silver halide ranges from 400 to 5, preferably from 200 to 10.

It is preferable that the total binder content in the image forming layer according to the invention ranges from 0.2 to 30 g/m$^2$, still preferably from 1 to 15 g/m$^2$ and still preferably from 2 to 10 g/m$^2$. The image forming layer according to the invention may further contain a crosslinking agent for crosslinkage, a surfactant for improving coating properties or the like.

Preferable Solvent for Coating Solution

In the present invention, it is preferable that the solvent (the term "solvent" as used herein includes not only a solvent but also a dispersion medium for convenience) for the coating solution for the organic silver-salt containing layer of the photosensitive material is an aqueous solvent containing 30% by weight or more of water. As the component other than water, use may be made of an arbitrary water-miscible organic solvent such as methyl alcohol, ethyl alcohol, isopropyl alcohol, methyl cellosolve, ethyl cellosolve, dimethylformamide or ethyl acetate. It is preferable that the water content of the solvent for the coating solution is 50% by weight or more, still preferably 70% by weight or more. Preferable examples of the solvent include water and mixtures of water/methyl alcohol=90/10, water/methyl alcohol=70/30, water/methyl alcohol/dimethylformamide=80/15/5, water/methyl alcohol/ethyl cellosolve=85/10/5, water/methyl alcohol/isopropyl alcohol=85/10/5 and so on (each value is expressed in % by weight).

Illustration of Antifogging Agent

As the antifogging agent, stabilizer and stabilizer precursor usable in the invention, citation may be made of the compounds described in JP-A-10$^{-62899}$, Paragraph No. 0070, European Patent No. 0803764 $\mu$l, p. 20, 1. 57 to p. 21, 1. 7, JP-A-9-281637 and JP-A-9-329864, and the compounds described in U.S. Pat. No. 6,083,681, U.S. Pat. No. 6,083,681 and European Patent No. 1048975. Organic halides are preferably employed as an antifogging agent in the invention. Examples thereof are the compounds disclosed in JP-A-11-65021 Paragraph Nos. 0111 to 0112. Among all, the organic halogen compounds represented by the formula (P) in JP-A-2000-284399, the organic polyhalides represented by the formula (II) in JP-A-10$^{-339934}$ and the organic polyhalogen compounds described in JP-A-2001-31644 and JP-A-2001-33911 are particularly preferable.

Illustration of Polyhalogen Compound

Next, organic polyhalogen compounds preferably in the invention will be specifically illustrated.

The polyhalogen compounds preferably usable in the invention are the compounds represented by the following formula (H).

Formula (H):

$$Q—(Y)n—C(Z_1)(Z_2)X$$

In the formula (H), Q represents an alkyl group, an aryl group or a heterocyclic group; Y represents a divalent linking group; n is 0 or 1; $Z_1$ and $Z_2$ represent each a halogen atom; and X represents a hydrogen atom or an electron-withdrawing group.

In the formula (H), Q preferably represents an aryl group or a heterocyclic group. In the case where Q in the formula (H) is a heterocyclic group, a nitrogen-containing heterocyclic group having 1 or 2 nitrogen atoms is preferable and a 2-pyridyl group or a 2-quinolyl group is still preferable. In the case where the behenic acid content in the organic silver salts falls within the range of from 50 to 85% by mol, it is particularly preferable from the viewpoint of achieving both of favorable image storage properties and development properties that Q is a heterocyclic group.

In the case where Q in the formula (H) is an aryl group, it is preferable that Q represents a phenyl group substituted by an electron-withdrawing group having a positive Hamet's substitution constant, i.e., σp value. Concerning the Hamet's substitution constant, reference may be made to Journal of Medicinal Chemistry, 1973, Vol. 16, No. 11, 1207 to 1216 or the like. Examples of such electron-withdrawing groups include halogen atoms (a fluorine atom (σp value: 0.06), a chlorine atom (σp value: 0.23), a bromine atom (σp value: 0.23), an iodine atom (σp value: 0.18)), trihalomethyl groups (a tribromomethyl group (σp value: 0.29), a trichloromethyl group (σp value: 0.33), a trifluoromethyl group (σp value: 0.54)), a cyano group (σp value: 0.66), a nitro group (σp value: 0.78), aliphatic aryl or heterocyclic sulfonyl groups (for example, methanesulfonyl (σp value: 0.72)), aliphatic aryl or heterocyclic acyl groups (for example, acetyl (σp value: 0.50), benzoyl (σp value: 0.43)), alkynyl groups (for example, C≡CH (σp value: 0.23)), aliphatic aryl or heterocyclic oxycarbonyl groups (for example, methoxycarbonyl (σp value: 0.45), phenoxycarbonyl (σp value: 0.44)), a carbamoyl group (σp value: 0.36), a sulfamoyl group (σp value: 0.57), a sulfoxide group, heterocyclic groups, a phosphoryl group and so on. It is preferable that the σp value ranges from 0.2 to 2.0, still preferably from 0.4 to 1.0. As the electron-withdrawing group, a carbamoyl group, an alkoxycarbonyl group, an alkylsulfonyl group and an alkylphosphoryl group are particularly preferable. Among all, a carbamoyl group is the most desirable one.

It is preferable that X is an electron-withdrawing group, still preferably a halogen atom, an aliphatic aryl or heterocyclic sulfonyl group, an aliphatic aryl or heterocyclic acyl group, an aliphatic aryl or heterocyclic oxycarbonyl group, a carbamoyl group or a sulfamoyl group. Halogen atoms are particularly preferable therefor. Among halogen atoms, a chlorine atom, a bromine atom and an iodine atom are preferable and a bromine atom is particularly preferable.

It is preferable that Y represents —C(=O)—, —SO— or —$SO_2$—, still preferably —C(=O)— or —$SO_2$— and —$SO_2$— is particularly preferable. n is 0 or 1, preferably 1.

Next, specific examples of the compounds of the formula (H) to be used in the invention will be presented.

(H-1)

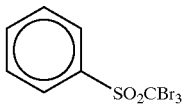

(H-2)

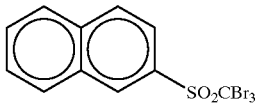

(H-3)

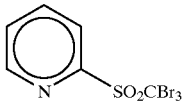

(H-4)

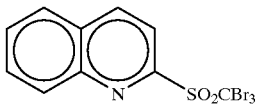

(H-5)

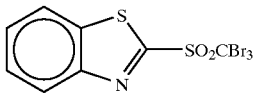

-continued (H-6)

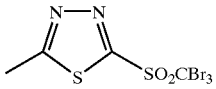

(H-7)

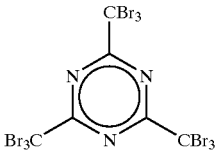

(H-8)

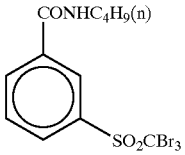

(H-9)

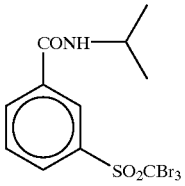

(H-10)

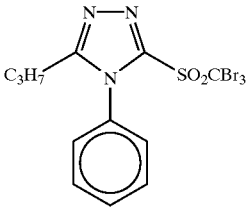

(H-11)

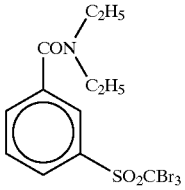

(H-12)

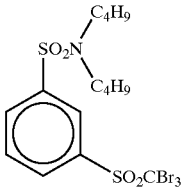

(H-13)

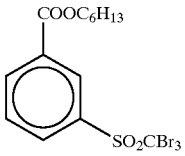

(H-14)

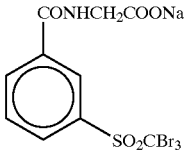

-continued (H-15)

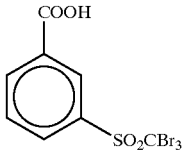

(H-16)

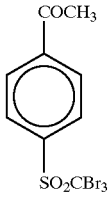

(H-17)

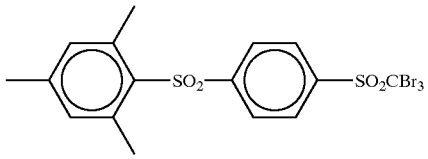

(H-18)

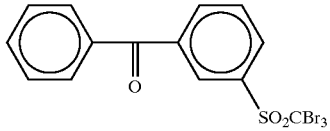

(H-19)

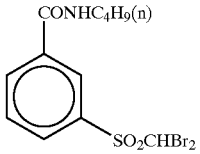

(H-20)

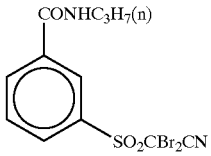

(H-21)

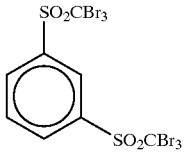

(H-22)

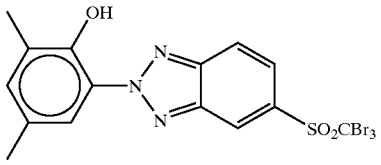

(H-23)

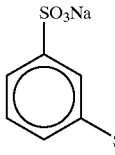

-continued (H-24)

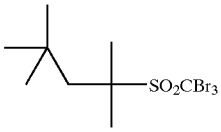

It is preferable that the compound represented by the above formula (H) is used in an amount of from $10^{-4}$ to 1 mol, still preferably from $10^{-3}$ to 0.5 mol and still preferably from $1\times10^{-2}$ to 0.2 mol per mol of the non-photosensitive silver salt in the image forming layer.

As the method of adding the antifogging agent to the photosensitive material in the invention, citation may be made of the methods described above concerning the addition of the reducing agent. It is also preferable to add the organic polyhalogen compound in the form of a dispersion of fine solid grains.

Other Antifogging Agents

Examples of other antifogging agents include the mercury (II) salts described in JP-A-11-65021, Paragraph No. 0113, the benzoic acids described in the same document Paragraph No. 0114, the salicylic acid derivatives described in JP-A-2000-206642, the formalin scavenger compounds represented by the formula (S) in JP-A-2000-221634, the triazine compounds according to claim 9 of JP-A-11-352624, the compounds represented by the formula (III) in JP-A-11-11791, 4-hydroxy-6-methyl-1,3,3,3a, 7-tetrazaindene and so on.

The photothermographic material according to the invention may contain an azolium salt in order to prevent fogging. Examples of the azolium salt include the compounds represented by the formula (XI) described in JP-A-59-193447, the compounds described in JP-B-55-12581, the compounds represented by the formula (II) in JP-A-60-153039 and so on. Although the azolium salt may be added to an arbitrary part of the photosensitive material, it is preferable to add it to the layer on the face having the photosensitive layer, still preferably to the organic silver salt-containing layer. The azolium salt may be added at an arbitrary point during the preparation of the coating solution. In the case of adding it to the organic silver salt-containing layer, it may be added at any point between the preparation of the organic silver salts and the preparation of the coating solution. However, it is preferable to add the azolium salt between the completion of the preparation of the organic silver salts and immediately before coating. The azolium salt may be added in an arbitrary form such as a powder, a solution or a dispersion of fine grains. It is also possible to add the azolium salt as a solution of a mixture thereof together with other additives such as a sensitizing dye, a reducing agent or a color tone controller. In the invention, the azolium salt may be added in an arbitrary amount. It is preferable to add the azolium salt in an amount of from $1\times10^{-6}$ mol to 2 mol, still preferably form $1\times10^{-3}$ mol to 0.5 mol, per mol of silver.

It is possible in the invention to add a mercapto compound, a disulfide compound or a thione compound for regulating or accelerating the development to thereby control the development, improving the spectral sensitization efficiency, improving the storage properties before and after the development, and the like. Namely, use can be made of the compounds described in JP-A-10-62899, Paragraph Nos. 0067 to 0069, the compounds represented by the formula (I) in JP-A-10-186572 and specific examples thereof as described in Paragraph Nos. 0033 to 0052, and the compounds described in European Patent No. 0803764A1, p. 20, lines 36 to 56. Among all, it is preferable to use the mercapto-substituted heterocyclic aromatic compounds described in JP-A-9-297367, JP-A-9-304875, JP-A-2001-100358, Japanese Patent Application 2001-104213, Japanese Patent Application 2001-104214 and so on.

Illustration of Color Tone Controller

It is preferable that the photothermographic material according to the invention contains a color tone controller. Color tone controllers are described in JP-A-10-62899, Paragraph Nos. 0054 to 0055, European Patent No. 0803764A1, p. 21, lines 23 to 48, JP-A-2000-356318 and JP-A-2000-187298. Preferable examples thereof include phthalazinones (phthalazinone, phthalazinone derivatives or metal salts; for example, 4-(1-naphthyl)phthalazinone, 6-chlorophthalazinone, 5,7-dimethoxyphthalazinone and 2,3-dihydro-1,4-phthalazinedione); combinations of phthalazinones with phthalic acids (for example, phthalic acid, 4-methylphthalic acid, 4-nitrophthalic acid, diammonium phthalate, sodium phthalate, potassium phthalate and tetrachloro phthalic anhydride); phthalazines (phthalazine, phthalazine derivatives or metal salts; for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine); and combinations of phthalazines with phthalic acids. Among all, the combinations of phthalazines with phthalic acids are preferable and a combination of 6-isopropylphthalazine with phthalic acid or 4-methylphthalic acid is still preferable.

Other Additives

A plasticizer and a lubricant usable in the photosensitive layer of the photosensitive material according to the invention are described in JP-A-11-65021, Paragraph No. 0117; a super contrast developer for forming a super contrast image, a method of adding the same and the amount thereof are described in the same document, Paragraph No. 0118, JP-A-11-223898, Paragraph Nos. 0136 to 0193, and use can be made of the compounds represented by the formula (H), the formulae (1) to (3) and the formulae (A) and (B) in JP-A-2000-284339 and the compounds represented by the formulae (III) to (V) in Japanese Patent Application 11-91652 (specific examples: the compounds Nos. 21 to 24); and a super contrast accelerator is described in JP-A-11-65021, Paragraph No. 0102 and JP-A-11-223898, Paragraph Nos. 0194 to 0195.

To employ formic acid or a formic acid salt as a strong fogging agent, such a compound is preferably contained in the side having the image forming layer containing the photosensitive silver halide in an amount of 5 mmol or less, still preferably 1 mmol or less, per mol of silver.

In the case where a super contrast developer is employed in the photothermographic material according to the invention, it is preferable to also use an acid formed by hydrating diphosphorus pentaoxide or its salt. Examples of the acid formed by hydrating diphosphorus pentaoxide include metaphosphoric acid (salts), pyrophosphoric acid (salts), orthophosphoric acid (salts), triphosphoric acid (salts), tetraphosphoric acid (salts), hexametaphosphoric acid (salts) and so on. Particularly preferable examples of acid formed by hydrating diphosphorus pentaoxide include orthophosphoric acid (salts) and hexametaphosphoric acid (salts). Specific examples thereof include sodium orthophosphate, sodium dihydrogen orthophosphate, sodium hexametaphosphate, ammonium hexametaphosphate and so on.

The acid formed by hydrating diphosphorus pentaoxide or its salt may be used in a desired amount (the coating dose per $m^2$ of the photosensitive material) depending on the sensitivity and the performance of fogging and the like. It preferably ranges from 0.1 to 500 mg/$m^2$, still preferably from 0.5 to 100 mg/$m^2$.

Illustration of Layer Structure

The photothermographic material according to the invention may be provided with a surface protective layer to, for example, prevent the image forming layer form adhesion. Either a single surface protective layer or a plural number of layers may be employed. Concerning the surface protective layer, reference may be made to JP-A-11-65021, Paragraph Nos. 0119 to 0120 and JP-A-2000-171936.

As the binder in the surface protective layer in the invention, it is preferable to use gelatin. It is also preferable to use polyvinyl alcohol (PVA) optionally together with gelatin. As the gelatin, use can be made of inert gelatin (for example, Nitta Gelatin 750), phthal-treated gelatin (for example, Nitta Gelatin 801) and so on. Examples of the PVA include those described in JP-A-2000-171936 Paragraph Nos. 0009 to 0020. It is preferable to use completely saponified PVA-105, partially saponified PVA-205 and PVA-335, denatured polyvinyl alcohol MP-203 (each manufactured by Kurary Co., Ltd.) and so on. The coating dose of polyvinyl alcohol (per $m^2$ of the substrate) in a single protective layer preferably ranges from 0.3 to 4.0 g/$m^2$, still preferably from 0.3 to 2.0 g/$m^2$.

In the case where the photothermographic material according to the invention is to be used for printing in which dimensional changes cause a particularly serious problem, it is favorable to use a polymer latex as the surface protective layer or a back layer. Such polymer latexes are described in "Gosei Jushi Emarujyon (ed. by Taira Okuda and Hiroshi Inagaki, Kobunshi Kanko-kai (1978))", "Gosei Ratekkusu no Oyo (ed. by Takaaki Sugimura, Yasuo Kataoka, Soichi Suzuki and Keiji Katahara, Kobunshi Kanko-kai (1993))", "Gosei Ratekkusu no Kagaku (Soichi Muroi, Kanko-kai (1970))" and so on. Specific examples thereof include a latex of a methyl methacrylate (33.5% by weight)/ethyl acrylate (50% by weight)/methacrylic acid (16.5% by weight) copolymer, a latex of a methyl methacrylate (47.5% by weight)/butadiene (47.5% by weight)/itaconic acid (5% by weight) copolymer, a latex of an ethyl acrylate (50% by weight)/methacrylic acid (50% by weight) copolymer, a latex of a methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer, a latex of a methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer and so on. As the binder for the surface protective layer, moreover, application may be made of the combination of the polymer latexes described in JP-A-11-6872, the technique described in JP-A-2000-267226, Paragraph Nos. 0021 to 0025, the technique described in JP-A-11-6872, Paragraph Nos. 0027 to 0028, and the technique described in JP-A-2000-19678, Paragraph Nos. 0023 to 0041. It is preferable that the ratio of the polymer latex in the surface protective layer ranges from 10% by weight to 90% by weight, still preferably from 20% by weight to 80% by weight, based on the total binders.

The coating dose (per $m^2$ of the substrate) of the total binders (including the water-soluble polymer and the latex polymer) in a single protective layer preferably ranges from 0.3 to 5.0 g/$m^2$, still preferably from 0.3 to 2.0 g/$m^2$.

It is advantageous that the coating solution for the image forming layer of the photosensitive material according to the invention is prepared at a temperature of from 30° C. to 65°

C., still preferably from 35° C. and lower than 60° C., still preferably from 35° C. to 55° C. It is preferable that, immediately after adding the polymer latex, the coating solution for the image forming layer is maintained at a temperature of from 30° C. to 65° C.

The image forming layer of the photosensitive material according to the invention is formed in one or more layers on the substrate. In the case where the image forming layer consists of a single layer, it comprises an organic silver salt, a photosensitive silver halide, a reducing agent and a binder optionally together with additional desired components such as a color tone controller, a coating aid and other auxiliary agents. In the case where the image forming layer consists of 2 or more layers, it is necessary that the organic silver salt and the photosensitive silver halide are contained in the first image forming layer (usually being adjacent to the substrate) while some other components are contained in the second image forming layer or the both. A multicolor photothermographic photographic material may contain a combination of these 2 layers for each color. Alternatively, all of the components may be contained in a single layer, as described in U.S. Pat. No. 4,708,928. In the case of a multi-dye multicolor photothermographic photographic material, individual emulsion layers are generally sustained separately by providing a functional or non-functional barrier layer between the photosensitive layers as reported by U.S. Pat. No. 4,460,681.

From the viewpoints of improving color tone, preventing the occurrence of interference fringes and preventing irradiation, it is possible in the invention to use various dyes and pigments (for example, C.I. Pigment Blue 60, C.I. Pigment Blue 64 of C.I. Pigment Blue 15:6) in the photosensitive layer. These pigments and dyes are described in detail in WO93/36322, JP-A-10-268465, JP-A-11-338098 and so on.

In the photothermographic material according to the invention, the photosensitive layer may be provided with an antihalation layer in the opposite side of the light source.

In general, a photothermographic material has non-photosensitive layer(s) in addition to a photosensitive layer. Depending on the location, these non photosensitive layers are classified into: (1) a protective layer formed on the photosensitive layer (in the opposite side of the substrate); (2) an intermediate layer formed between a plural number of photosensitive layers or between the photosensitive layer and a protective layer; (3) an undercoating layer formed between the photosensitive layer and the substrate; and (4) a back layer formed in the opposite side of the photosensitive layer. The photosensitive material may be provided with a filter layer as the layer (1) or (2). The photosensitive material may be provided with an antihalation layer as the layer (3) or (4).

Concerning the antihalation layer, reference may be made to JP-A-11-65021, Paragraph Nos. 0123 to 0124, JP-A-11-223898, JP-A-9-230531, JP-A-10$^{-36695}$, JP-A-10$^{-104779}$, JP-A-11-231457, JP-A-11-352625, JP-A-11-352626 and so on.

The antihalation layer contains an antihalation dye having an absorption at the exposure wavelength. In the case where the exposure wavelength resides in the infrared region, use may be made of an infrared absorption dye. In this case, it is preferable to use a dye having no absorption in the visible region.

In the case where it is intended to prevent halation by using a dye having absorption in the visible region, it is preferable that the color of the dye does not substantially remain after the image formation. Thus, it is preferable to employ a method of discoloring due to the heat at the thermal development. It is particularly preferable to add a thermal discoloring dye and a base precursor to the non-photosensitive layer to impart a function as an antihalation layer. This technique is described in JP-A-11-231457 and so on.

The amount of the discoloring dye to be added is determined depending on the purpose of using the dye. In general, the dye is used in such an amount as giving an optical density (absorptivity) exceeding 0.1 when measured at the aimed wavelength. The optical density preferably ranges from 0.15 to 2, still preferably from 0.2 to 1. To achieve such an optical density, the dye is usually employed in an amount of from about 0.001 to 1 g/m$^2$.

By discoloring the dye, the optical density after the thermal development can be lowered to 0.1 or less. Use may be made of 2 or more discoloring dyes together in a thermal discoloring recording material or a photothermographic material. Similarly, use may be made of 2 or more base precursors together.

In the thermal discoloring with the use of a discoloring dye and a base precursor as described above, it is preferable from the viewpoint of heat discoloring properties and the like to use together a substance capable of lowering the melting pint by 3° C. (deg) or more when mixed with the base precursor (for example, diphenylsulfone, 4-chlorophenyl (phenyl) sulfone or 2-naphthyl benzoate).

In the invention, a coloring agent having an absorption peak at 300 to 450 nm can be added in order to improve the silver color tone and changes in the image with the passage of time. These coloring agents are described in JP-A-62-210458, JP-A-63-104046, JP-A-63-103235, JP-A-63-208846, JP-A-63-306436, JP-A-63-314535, JP-A-01-61745., JP-A-2001-100363 and so on.

The coloring agent is usually added in an amount of from 0.1 mg/m$^2$ to 1 g/m$^2$. It is preferably added to the back layer which is formed in the opposite side of the photosensitive layer.

It is preferable that the photothermographic material according to the invention is a so-called one-face photosensitive material which has at least one photothermographic material containing a silver halide emulsion in one side of the substrate and a back layer in the other side.

Illustration of Matting Agent

In the invention, it is preferable to add a matting agent to improve the transport properties. Matting agents are described in JP-A-11-65021, Paragraph Nos. 0126 to 0127. The matting agent is employed preferably in an amount of from 1 to 400 mg/m$^2$ still preferably from 5 to 300 mg/m$^2$, expressed in the coating dose per m$^2$ of the photosensitive material.

In the invention, the matting agent may be either a shaped or amorphous one. It is preferable to use a shaped matting agent, still preferably a spherical matting agent. The average grain size preferably ranges from 0.5 to 10 $\mu$m, still preferably from 1.0 to 8 $\mu$m and still preferably from 2.0 to 6.0 $\mu$m. The coefficient of variation in the size distribution is preferably 50% or less, still preferably 40% or less and still preferably 30% or less. The term "coefficient of variation" as used herein means a value expressed in (standard deviation of grain size)/(average grain size)×100. It is also preferable to use 2 matting agents having a small coefficient of variation and an average grain size ratio of 3 or more.

In the invention, the degree of mattness of the emulsion face may be at an arbitrary level, so long as there arises no so-called stardust failure, i.e., the formation of small white spots and light leakage in the image. It is preferable that the Bekk smoothness ranges from 30 sec to 2000 sec, still preferably from 40 sec to 1500 sec. Bekk smoothness can be easily determined in accordance with Japanese Industrial Standards (JIS) P8119 "Method of testing smoothness of paper and board paper with Bekk tester" and TAPPI standard method T479.

In the invention, the degree of mattness of the back layer represented by Bekk smoothness preferably ranges from 1200 sec to 10 sec, still preferably from 800 sec to 20 sec and still preferably from 500 sec to 40 sec.

It is preferable in the invention that the matting agent is contained in the outermost surface layer, a layer serving as the outermost surface layer, or a layer close to the outer surface. It is also preferable that the matting agent is contained in a layer serving as a so-called protective layer.

Back layers applicable to the invention are described in JP-A-11-65021, Paragraph Nos. 0128 to 0130.

It is preferable in the photothermographic material according to the invention that the pH value at the film face before the thermal development is 7.0 or less, still preferably 6.6 or less. The lower limit is about 3, though it is not particularly restricted. The most desirable pH range is from 4 to 6.2. To control the film face pH value, it is preferable from the viewpoint of lowering the film face pH value to use a non-volatile acid such as an organic acid such as a phthalic acid derivative or sulfuric acid or a volatile base such as ammonia. In particular, ammonia is preferably employed in achieving a low pH value at the film face, since it is highly volatile and can be eliminated before the coating step or the thermal development.

It is also preferable to use a combination of a non-volatile base such as sodium hydroxide, potassium hydroxide or lithium hydroxide with ammonia. A method of measuring the pH value at the film face is described in JP-A-2000-284339, Paragraph No. 0123.

In the layers in the invention such as the photosensitive layer, the protective layer and the back layer, use may be made of a hardening agent. Examples of the hardening agent are described in T. H. James, "THE THEORY OF THE PHOTOGRAPHIC PROCESS FOURTH EDITION" (Macmillan Publishing Co., Inc., 1977), pp. 77 to 87. It is preferable to use chrome alum, 2,4-dichloro-6-hydroxy-s-triazine sodium salt, N,N-ethylenebis(vinylsulfonamide), N,N-propylenebis(vinylsulfoneacetamide), polyvalent metal ions cited p. 78 in the above reference and soon, polyisocyanates described in U.S. Pat. No. 4,281,060, JP-A-6-208193 and so on, epoxy compounds described in U.S. Pat. No. 4,791,042 and so on, and vinylsulfone compounds described in JP-A-62-89084.

The hardening agent is added as in the form of a solution. This solution is to be added to the coating solution for the protective layer from 180 minutes before the coating to immediately before the coating, preferably from 60 minutes before the coating to 10 seconds before the coating. The mixing method and conditions are not particularly restricted, so long as the effect of the invention can be sufficiently achieved. As a specific mixing method, use can be made of a method of mixing in a tank while controlling the average retention time to a desired level calculated based on the addition flow rate and the feeding rate to the coater, or the method using a static mixer as described in N. Harnby, M. F. Edwards and A. W. Nienow, translated by Koji Takahashi "Ekitai Kongo Gijutsu" (Nikkan Kogyo Shinbun, 1989), Chapter 8 or the like.

Surfactants applicable to the invention other than the specific fluorine compound as described above are presented in JP-A-11-65021, Paragraph No. 0132. On the other hand, solvents are described in ibid. Paragraph No. 0133, substrates are described in ibid. Paragraph No. 0134, antistatic or conductive layers are described in ibid. Paragraph No. 0135, a method of obtaining a color image is described in ibid. Paragraph No. 0136, slipping agents are described in JP-A-11-84573 Paragraph Nos. 0061 to 0064 and JP-A-11-1-6881, Paragraph Nos. 0049 to 0062.

It is preferable that the photothermographic material according to the invention has a conductive layer containing a metal oxide. As a conductive material in the conductive layer, use is preferably made of a metal oxide having conductive properties elevated by introducing an oxygen-defective different metal atom thereinto. Preferable examples of the metal oxide include ZnO, $TiO_2$ and $SnO_2$. It is preferable to add Al or In to ZnO, to add Sb, Nb, P or a halogen atom to $SnO_2$, or to add Nb, Ta or the like to $TiO_2$. Among all, $SnO_2$ to which Sb has been added is preferable. It is preferable that the different atom is added in an amount of from 0.01 to 30% by mol, still preferably from 0.1 to 10% by mol. The metal oxide may be in the shape of spheres, needles or plates. From the viewpoint of the effect of imparting conductivity, needle type grains having a major axis/minor axis ratio of 2.0 or more, still preferably 3.0 to 50, are preferable. It is preferable to use the metal oxide in an amount of from 1 $mg/m^2$ to 1000 $mg/m^2$, preferably from 10 $mg/m^2$ to 500 $mg/m^2$ and still preferably from 20 $mg/m^2$ to 200 $mg/m^2$. The conductive layer of the invention may be located either in the emulsion face side or in the back face side. It is preferable to provide the conductive layer between the substrate and the back layer. Specific examples of the conductive layer of the invention are described in JP-A-7-295146 and JP-A-223901.

In the case where a surfactant other than the specific fluorine compound as described above is used in the invention, it is preferable that the surfactant to be used together is also a fluorine-based surfactant. Specific examples of the fluorine-based surfactants include the compounds described in JP-A-10-197985, JP-A-2000-19680, JP-A-2000-214554 and so on. Also, use may be preferably made of the high-molecular weight fluorine-based surfactants described in JP-A-9-281636. In the photothermographic material according to the invention, it is preferable to use the fluorine-based surfactants described in Japanese Patent Application 2000-206560, Japanese Patent Application 2001-203462 and the invention.

In the invention, the fluorine-based surfactant including the specific fluorine compound as described above can be used either in the emulsion face or the back face. It is preferable to use such a surfactant in both of these faces. It is particularly preferable to use a combination of the surfactant with the metal oxide-containing conductive layer as described above. In this case, a sufficient performance can be established even though the fluorine-based surfactant is used in a reduced amount or not employed in the face having the conductive layer.

It is preferable that the fluorine-based surfactant including the specific fluorine compound as described above is used in an amount of from 0.1 $mg/m^2$ to 100 $mg/m^2$ in each of the emulsion face and the back face, still preferably from 0.3 $mg/m^2$ to 30 $mg/m^2$ and still preferably from 1 $mg/m^2$ to 10 $mg/m^2$. Since the fluorine-based surfactant according to the invention is particularly effective, it is preferably used in an amount of from 0.01 $mg/m^2$ to 10 $mg/m^2$, still preferably from 0.1 $mg/m^2$ to 5 $mg/m^2$.

To relieve inner stain remaining in the film during the biaxial orientation and to eliminate heat-shrinkage strain occurring during the thermal development, it is preferable that the transparent substrate is made of a polyester (in particular, polyethylene terephthalate) having been heated to 130 to 185° C. In the case of a photothermographic material for medical use, the transparent substrate may be colored with a blue dye (for example, Dye-1 described in JP-A-8-240877) or not colored. It is preferable that the substrate has been undercoated by applying techniques with the use of the water-soluble polymers described in JP-A-11-84574, the styrene-butadiene copolymers described in JP-A-10-186565, the vinylidene chloride copolymers described in JP-A-2000-36984 and Japanese Patent Application 11-106881, Paragraph Nos. 0063 to 0080 and so on. Concerning the antistatic layer of the undercoating, application can be made of the techniques described in JP-A-56-143430, JP-A-56-143431, JP-A-58-62646, JP-A-56-120519, JP-A-11-84573 Paragraph Nos. 0040 to 0051, U.S. Pat. No. 5,575,957 and JP-A-11-223898 Paragraph Nos. 0078 to 0084.

It is preferable that the photothermographic material is in the mono-sheet type (i.e., a type allowing the formation of an image directly on the photothermographic material without resort to any other sheets such as an image receiver).

The photothermographic material may further contain an antioxidant, a stabilizer, a plasticizer, an UV absorber or a coating aid. These various additives are added either to the photosensitive layer or the non-photosensitive layer. Concerning these additives, reference can be made to WO98/36322, EP803764A1, JP-A-10-186567, JP-A-10-18568 and so on.

The photothermographic material according to the invention may be coated by an arbitrary method. More specifically speaking, use may be made of various coating procedures such as extrusion coating, slide coating, curtain coating, dip coating, knife coating, flow coating and extrusion coating with the use of a hopper of the type as described in U.S. Pat. No. 2,681,294. It is preferable to employ the extrusion coating or the slide coating described in Stephen F. Kistler and Peter M. Schweizer "LIQUID FILM COATING" (CHAPMAN & HALL, 1997), pp. 399 to 536. It is particularly preferably to use the slide coating. Examples of the shape of a slide coater to be used in the slide coating are given in p. 427, FIG. 11b.1 in this reference. If desired, it is also possible to simultaneously coat 2 or more layers by the method described in pp. 399 to 536 of the above reference or the methods described in U.S. Pat. No. 2,761,791 and British Patent No. 837,095.

It is preferable that the coating solution for the organic silver salt-containing layer in the invention is a so-called thixotropic fluid. Concerning this technique, reference can be made to JP-A-11-52509. It is preferable that the coating solution for the organic silver salt-containing layer in the invention has a viscosity at a shear rate of 0.1 $S^{-1}$ of from 400 mPa·s to 100,000 mPa·s, still preferably from 500 mPa·s to 20,000 mPa·s. It is also preferable that the viscosity thereof at a shear rate of 1000 $S^{-1}$ ranges from 1 mPa·s to 200 mPa·s, still preferably from 5 mPa·s to 80 mPa·s.

Examples of techniques usable in the photothermographic material according to the invention further include those described in EP803764A1, EP883022A1, WO98/36322, JP-A-56-62648, JP-A-58-62644, JP-A-9-43766, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197895 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312083, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-11-305377, JP-A-11-305378, JP-A-11-305384, JP-A-11-305380, JP-A-11-316435, JP-A-11-327076, JP-A-11-338096, JP-A-11-338098, JP-A-11-338099, JP-A-11-343420, JP-A-2000-187298, JP-A-2000-10229, JP-A-2000-47345, JP-A-2000-206642, JP-A-2000-98530, JP-A-2000-98531, JP-A-2000-112059, JP-A-2000-112060, JP-A-2000-112104, JP-A-2000-112064 and JP-A-2000-171936.

Illustration of Packaging Material

To lessen variation in the photographic performance during storage in the raw state or to improve curling and winding properties, it is preferable that the photothermographic material according to the invention is packaged in a packaging material having a low oxygen permeability and/or a low moisture permeability. It is preferable that the oxygen permeability at 25° C. is 50 ml/atm·$m^2$·day or less, still preferably 10 ml/atm·$m^2$·day or less and still preferably 1.0 ml/atm·$m^2$·day or less. It is preferable that the moisture permeability is 10 g/atm·$m^2$·day or less, still preferably 5 g/atm·$m^2$·day or less and still preferably 1 g/atm·$m^2$·day or less.

Specific examples of the packaging material having a low oxygen permeability and/or a low moisture permeability are the packaging materials described in, for example, JP-A-8-254793 and JP-A-2000-206653.

Illustration of Thermal Development

Although the photothermographic material according to the invention may be developed by an arbitrary method, it is usually developed by heating the photothermographic material which has been exposed in image width. The development temperature ranges preferably from 80 to 250° C., still preferably from 100 to 140° C. and still preferably from 110 to 130° C. The development time ranges preferably from 1 to 60 seconds, still preferably from 3 to 30 seconds, still preferably from 5 to 25 seconds and particularly preferably from 7 to 15 seconds.

As the thermal development system, use may be made of either a drum heater or a plate heater. The plate heater system is preferred. As the thermal development method with the use of the plate heater system, it is preferable to employ the method described in JP-A-11-133572 using a thermal development apparatus wherein a photothermographic material having a latent image formed thereon is brought into contact with a heating unit in a thermal development part to thereby give a visible image. This apparatus is characterized in that the heating unit is a plate heater, a plural number of holding rollers are provided oppositely along one face of the plate heater, and the photothermographic material is passed between the holding rollers and the plate heater to thereby perform thermal development. It is preferable that the plate heater has 2 to 6 terraces and the temperature is lowered by 1 to 10° C. at each front edge. For example, use is made of 4 sets of plate heaters respectively controlled to 112° C., 119° C., 121° C. and 120° C. Using this method which is also described in JP-A-54-30032, the moisture or the organic solvent contained in the photothermographic material can be eliminated from the system. It is also possible to prevent changes in the substrate shape of the photothermographic material caused by quickly heating the photothermographic material.

The photothermographic material according to the invention may be exposed by an arbitrary method. As an exposure light source, it is preferable to use laser beams. Preferable examples of the laser beams to be used in the invention include a gas lasers ($Ar^+$, He—Ne), a YAG laser, a pigment laser, a semiconductor laser and so on. It is also possible to use a semiconductor laser together with a second high frequency generator. It is preferable to employ a red to infrared luminescent gas or a semiconductor laser.

As an example of a laser imager for medical use provided with an exposure unit and a thermal development unit, Fuji Medical Dry Laser Imager FM-DP L can be cited. FM-DP L is described in Fuji Medical Review No. 8, pp. 39 to 55. It is needless to say that these techniques are applicable as a laser imager to the photothermographic material according to the invention. Moreover, the photothermographic material according to the invention is usable as a photothermographic material for a laser imager in "AD network" which is proposed by Fuji Medical System as a network system fulfilling DICOM standards.

The photothermographic material according to the invention, which forms a white and black image by a silver image, is preferably used as a photothermographic material for medical diagnosis, a photothermographic material for industrial photography, a photothermographic material for printing and a photothermographic material for COM.

EXAMPLES

Now, the invention will be illustrated in greater detail by reference to the following Examples. However, it is to be understood that, the invention is not construed as being restricted thereto.

Production of PET Substrate

Using terephthalic acid and ethylene glycol, PET having an intrinsic viscosity IV=0.66 (measured in phenol/tetrachloroethane=6/4 by weight at 25° C.) was obtained. After pelletizing, the PET was dried at 130° C. for 4 hours, extruded from a T-die at 300° C. and quenched. Thus, a non-oriented film having such a thickness as giving a film thickness of 175 μm after thermal fixation was produced.

Next, the obtained film was oriented 3.3-fold lengthwise with the use of rolls having different circumferential speeds and then 4.5-fold crosswise with the use of a tenter respectively at 110° C. and 130° C. Next, it was thermally fixed at 240° C. for 20 seconds followed by relaxation by 4% crosswise at the same temperature. After slitting the chuk of the tenter, the both ends were knurled. Then the film was wound at 4 kg/cm$^2$ to give a roll of 175 μm in thickness.

Surface Corona Treatment

Using a solid state corona treatment machine Model 6 KVA (manufactured by Pillar Technologies), the substrate was treated in both faces at room temperature at 20 m/min. From the current and voltage data during this period, it was understood that the substrate was treated at 0.375 kV·A·min/m$^2$. The treatment frequency was 9.6 Hz and the gap clearance between the electrode and the dielectric roll was 1.6 mm.

Production of Undercoated Substrate

Preparation of Coating Solution for Undercoating Layer

| Formulation (1) (for undercoating layer in the photosensitive layer side) | |
|---|---|
| PES RESIN A-520, manufactured by Takamatsu Oil & Fat Co., Ltd., (30% by weight solution) | 59 g |
| polyethylene glycol monononylphenyl ether (average ethylene oxide number = 8.5) 10% by weight solution | 5.4 g |
| MP-100, manufactured by Soken Chemical and Engineering Co., Ltd., (fine polymer grains, average grain size 0.4 μm) | 0.91 g |
| distilled water | 935 ml |
| **Formulation (2) (for first layer in back face)** | |
| styrene-butadiene copolymer latex (solid content 40% by weight, styrene/butadiene weight ratio = 68/32) | 158 g |
| 2,4-dichloro-6-hydroxy-S-triazine sodium salt 8% by weight aqueous solution | 20 g |
| sodium laurylbenzenesulfonate, 1% by weight aqueous solution | 10 ml |
| distilled water | 854 ml |
| **Formulation (3) (for second layer in back face side)** | |
| $SnO_2$/SbO (9/1 by mass, average grain size 0.083 μm, 17% by weight dispersion) | 84 g |
| gelatin (10% by weight aqueous solution) | 89.2 g |
| Metolose TC-5, manufactured by Shin Etsu Chemical Co., Ltd., (2% by weight aqueous solution) | 8.6 g |
| MP-1000, manufactured by Soken Chemical and Engineering Co., Ltd. | 0.01 g |
| sodium dodecylbenzenesulfonate, 1% by weight aqueous solution | 10 ml |
| NaOH (1% by weight) | 6 ml |
| Proxel (manufactured by ICI) | 1 ml |
| distilled water | 805 ml |

The biaxially oriented polyethylene terephthalate substrate of 175 μm in thickness as described above was corona-treated in both faces. Next, one face (the photosensitive layer face) was coated with the coating solution for undercoating of the formulation (1) as described above at a wet coating dose of 6.6 ml/m$^2$ (per face) with the use of a wire bar and then dried at 180° C. for 5 minutes. Subsequently, the opposite face (the back face) was coated with the coating solution for undercoating of the formulation (2) as described above at a wet coating dose of 5.7 ml/m$^2$ with the use of a wire bar and then dried at 180° C. for 5 minutes. Further, the opposite face (the back face) was coated with the coating solution for undercoating of the formulation (3) as described above at a wet coating dose of 7.7 ml/m$^2$ with the use of a wire bar and then dried at 180° C. for 5 minutes. Thus an undercoated substrate was produced.

Preparation of Coating Solution for Back Face

Preparation of Dispersion (a) of Fine Solid Base Precursor Grains 1.5 kg of abase precursor compound 1, 225 g of a surfactant (Demol™ N manufactured by Kao Corporation), 937.5 g of diphenyl phosphine and 15 g of butyl p-hydroxybenzoate (Mekkins™: manufactured by Ueno Seiyaku) were mixed with distilled water to give a total amount of 5.0 kg. The liquid mixture thus obtained was subjected to bead-dispersion by using a horizontal sand mill (UVM-2: manufactured by IMEX Co., Ltd.). The dispersion was carried out by feeding the liquid mixture with a diaphragm pump to the UVM-2 packed with zirconia beads having an average grain size of 0.5 mm and then dispersed under an inner pressure of 50 hPa or above until the desired grain size was obtained.

The dispersion was continued until the ratio of the absorbance of the spectral absorption of the dispersion at 450 nm to its absorbance at 650 nm (D450/D650), measured by spectrometry, attained 2.2 or more. The obtained dispersion was diluted with distilled water so as to give a concentration of the base precursor of 20% by weight and then filtered through a polypropylene filter (average pore size: 3 μm) to eliminate contaminants before using in practice.

Preparation of Dispersion of Fine Solid Dye Grains 6.0 kg of a cyanine dye compound 1 (the structural formula of which will be shown hereinafter), 3.0 kg of sodium p-dodecylbenzenesulfonate, 0.6 kg of a Demol™ SNB manufactured by Kao Corporation and 0.15 kg of a defoaming agent (Surfynol™ 104E, manufactured by Nisshin Chemical Industries Co., Ltd.) were mixed with distilled water to give a total amount of 60 kg. The liquid mixture thus obtained was dispersed by using zirconia beads of 0.5 mm in a horizontal sand mill (UVM-2: manufactured by IMEX Co., Ltd.).

The dispersion was continued until the ratio of the absorbance of the spectral absorption of the dispersion at 650 nm to its absorbance at 750 nm (D650/D750), measured by spectrometry, attained 5.0 or more. The obtained dispersion was diluted with distilled water so as to give a concentration of the cyanine dye of 6% by weight and then filtered through a filter (average pore size: 1 μm) to eliminate contaminants before using in practice.

Preparation of Coating Solution for Antihalation Layer 30 g of gelatin, 24.5 g of polyacrylamide, 2.2 g of 1 mol/l sodium hydroxide, 2.4 g of fine polymethyl methacrylate grains in monodispersion (average grain size 8 μm, standard deviation of grain size 0.4), 0.08 g of benzoisothiazolinone, 35.9 g of the above-described dispersion of fine solid dye grains, 74.2 g of the above-described dispersion (a) of fine solid base precursor grains, 0.6 g of sodium polyethylenesulfonate, 0.21 g of a blue dye compound 1 (the structural formula of which will be shown hereinafter), 0.15 g of a yellow dye compound 1 (the structural formula of which will be shown hereinafter) and 8.3 g of an acrylic acid/ethyl acrylate copolymer latex were mixed together and water was further added to give a total volume of 818 ml. Thus a coating solution of the antihalation layer was prepared.

Preparation of Coating Solution of Back Face Protective Layer

While maintaining a container at 40° C., 40 g of gelatin, 1.5 g (in terms of liquid paraffin) of a liquid paraffin emulsion, 35 mg of benzoisothiazolinone, 6.8 g of 1 mol/l sodium hydroxide, 0.5 g of sodium t-octylphenoxyethoxyethanesulfonate, 0.27 g of sodium polystyrenesulfonate, 5.4 ml of a 2% aqueous solution of a fluorine-based surfactant (SF-1: the structural formula of which will be shown hereinafter), 5.4 ml of a 2% aqueous solution of a fluorine-based surfactant (SF-2: the structural formula of which will be shown hereinafter), 6.0 g of an acrylic acid/ethyl acrylate copolymer (copolymerization ratio by weight 5/95) and 2.0 g of N,N-ethylenebis (vinylsulfonacetamide) were mixed together and water was further added to give a total volume of 1000 ml. Thus, a coating solution for the back face protective layer was prepared.

Preparation of Silver Halide Emulsion

<<Preparation of Silver Halide Emulsion 1>>

To 142 ml of distilled water was added 3.1 ml of a 1% by weight solution of potassium bromide. Further, 3.5 ml of 0.5 mol/L sulfuric acid and 31.7 g of gelatin phthalide were added. The liquid mixture thus obtained was maintained at a liquid temperature of 30° C. while stirring in a stainless reaction pot. Then a solution A prepared by diluting 22.22 g of silver nitrate with distilled water to give a total volume of 95.4 ml and another solution B prepared by diluting 15.3 g of potassium bromide and 0.8 g of potassium iodide with distilled water to give a total volume of 97.4 ml were added each as a whole at a constant flow rate over 45 seconds. Subsequently, 10 ml of a 3.5% by weight aqueous solution of hydrogen peroxide and 10.8 ml of a 10% by weight aqueous solution of benzoimidazole were successively added thereto. Moreover, a solution C prepared by diluting 51.86 g of silver nitrate with distilled water to give a total volume of 317.5 ml and a solution D prepared by diluting 44.2 g of potassium bromide and 2.2 g of potassium iodide with distilled water to give a total volume to 400 ml were added. The solution C was added as a whole at a constant flow rate over 20 minutes, while the solution D was added by the controlled double jet method while maintaining pAg at 8.1. 10 minutes after the initiation of the addition of the solution C and the solution D, potassium hexachloroiridate (III) was added at once in an amount of $1\times10^{-4}$ Mol per mol of silver. 5 seconds after the completion of the addition of the solution C, a solution of iron (II) potassium hexacyanide was added at once in an amount of $3\times10^{-4}$ mol per mol of silver. Then the mixture was adjusted to pH 3.8 with the use of 0.5 mol/L sulfuric acid. After stopping stirring, the mixture was subjected to precipitation/desalting/washing with water. Next, the mixture was adjusted to pH 5.9 with the use of 1 mol/L sodium hydroxide, thereby giving a silver halide dispersion of pAg 8.0.

The above-described silver halide dispersion was maintained at 38° C. under stirring and 5 ml of a 0.34% by weight solution of 1,2-benzoisothiasolin-3-one in methanol was added thereto. After 40 minutes, the mixture was heated to 47° C. 20 minutes after heating, a solution of sodium benzenethiosulfonate in methanol was added in an amount of $7.6\times10^{-5}$ mol per mol of silver. 5 minutes thereafter, a solution of a tellurium sensitizer C (the structural formula of which will be shown hereinafter) in methanol was added in an amount of $2.9\times10^{-4}$ mol per mol of silver and the resultant mixture was aged for 91 minutes. Subsequently, a solution of a spectral sensitizing dye A (the structural formula of which will be shown hereinafter) and a spectral sensitizing dye B (the structural formula of which will be shown hereinafter) in methanol at a molar ratio of 3:1 was added in an amount of $1.2\times10^{-3}$ mol of the spectral sensitizing dyes A and B per mol of silver. After 1 minute, 1.3 ml of a 0.8% by weight solution of N,N'-dihydroxy-N"-diethylmelamine in methanol was added. After 4 minutes, a solution of 5-methyl-2-mercaptobenzoimidazole in methanol in an amount of $4.8\times10^{-3}$ mol per mol of silver, a solution of 1-phenyl-2-heptyl-5-mercapto-1,3,4-triazole in methanol in an amount of $5.4\times10^{-3}$ mol per mol of silver and an aqueous solution of 1-(3-methylureido)-5-mercaptotetrazole sodium salt in an amount of $8.5\times10^{-3}$ mol per mol of silver were added thereto to give a silver halide emulsion 1.

Grains contained in the silver halide emulsion thus prepared were silver iodobromide grains which had an average size as spheres of 0.042 μm and a coefficient of variation as spheres of 20% and uniformly contained 3.5% by mol of iodo. The grain size etc. were determined by calculating the average of 1000 grains with the use of an electron microscope. The plane [100] ratio of these grains was determined as 80% using the Kubelka Munk transformation method.

<<Preparation of Silver Halide Emulsion 2>>

A silver halide emulsion 2 was prepared as in the preparation of the silver halide emulsion 1 but changing the liquid temperature in the grain formation from 30° C. to 47° C., preparing the solution B by diluting 15.9 g of potassium bromide with distilled water to give a total volume of 97.4 ml, preparing the solution D by diluting 45.8 g of potassium bromide with distilled water to give a total volume of 400 ml, adding the solution C over 30 minutes and using no iron (II) potassium hexacyanide. Then it was subjected to precipitation/desalting/washing with water/dispersion as in the case of the silver halide emulsion 1. Further, spectral sensitization, chemical sensitization and the addition of 5-methyl-2-mercaptobenzoimidazole and 1-phenyl-2-heptyl-5-mercapto-1,3,4-triazole were carried out as in the case of the silver halide emulsion 1 but adding the tellurium sensitizer C in an amount of $1.1\times10^{-4}$ mol per mol of silver, adding a solution of the spectral sensitizing dye A and the spectral sensitizing dye B in methanol at a molar ratio of 3:1 in an amount of $7.0\times10^{-4}$ mol of the spectral sensitizing dyes A and B per mol of silver, and adding 1-phenyl-2-heptyl-5-mercapto-1,3,4-triazole in an amount of $3.3\times10^{-3}$ mol per mol of silver. Thus, a silver halide emulsion 2 was obtained. Grains contained in the silver halide emulsion 2 were cubic grains of pure silver bromide which had an average size as spheres of 0.080 $\mu$m and a coefficient of variation as spheres of 20%.

<<Preparation of Silver Halide Emulsion 3>>

A silver halide emulsion 3 was prepared as in the preparation of the silver halide emulsion 1 but changing the liquid temperature in the grain formation from 30° C. to 27° C. Then it was subjected to precipitation/desalting/washing with water/dispersion as in the case of the silver halide emulsion 1. Further, the procedure employed in the preparation of the silver halide emulsion 1 was followed but adding a solid dispersion (aqueous gelatin solution) of the spectral sensitizing dye A and the spectral sensitizing dye B at a molar ratio of 1:1 in an amount of $6\times10^{-3}$ mol of the spectral sensitizing dyes A and B per mol of silver, changing the amount of tellurium sensitizer C to $5.2\times10^{-4}$ mol per mol of silver, and 3 minutes after the addition of the tellurium sensitizer, adding aurous bromide in an amount of $5\times10^{-4}$ mol per mol of silver and potassium thiocyanate in an amount of $2\times10^{-3}$ mol per mol of silver. Thus, a silver halide emulsion 3 was obtained. Grains contained in the silver halide emulsion 3 were silver iodobromide grains which had an average size as spheres of 0.034 $\mu$m and a coefficient of variation as spheres of 20% and uniformly contained 3.5% by mol of iodo.

<<Preparation of Mixed Emulsion A for Coating Solution>>

70% by weight of the silver halide emulsion 1, 15% by weight of the silver halide emulsion 2 and 15% by weight of the silver halide emulsion 3 were dissolved and a 1% by weight aqueous solution of benzothiazolium iodide was added thereto in an amount of $7\times10^{-3}$ mol per mol of silver. Further, water was added thereto to give a silver halide content (in terms of silver) of 38.2 g per kg of the mixed emulsion for coating solution. Further, 1-(3-methylureiso)-5-mercaptotetrasole sodium salt was added in an amount of 0.34 g per kg of the mixed emulsion for coating solution.

<<Preparation of Fatty Acid Silver Salt Dispersion A>>

87.6 kg of behenic acid (Edenor™ C22-85R manufactured by Henkel), 423 L of distilled water, 49.2 L of a 5 mol/L aqueous solution of NaOH and 120 L of t-butyl alcohol were mixed together and reacted for 1 hours under stirring at 75° C. to thereby give a sodium behenate solution A. Separately, 206.2 L of an aqueous solution of 40.4 kg of silver nitrate (pH 4.0) was prepared and maintained at 10° C. A reactor containing 635 L of distilled water and 30 L of t-butyl alcohol was maintained at 30° C. Under thoroughly stirring, the whole sodium behenate solution A and the whole aqueous solution of silver nitrate as described above were added thereto at a constant flow rate respectively over 93 minutes and 15 seconds and 90 minutes. In this step, the aqueous silver nitrate solution alone was added within 11 minutes following the initiation of the addition of the aqueous silver nitrate solution and then the addition of the sodium behenate solution A was initiated. Within 14 minutes and 15 seconds following the completion of the addition of the aqueous silver nitrate solution, the sodium behenate solution A alone was added. During this procedure, the reactor was maintained at 30° C. and the external temperature was controlled so that the liquid temperature was maintained at the constant level. The pipe through which the sodium behenate solution A was added was maintained at a definite temperature by circulating warm water outside of the double-structured pipe and the liquid temperature was controlled to 75° C. at the outlet of the front end of the addition nozzle. On the other hand, The pipe through which the aqueous silver nitrate solution was added was maintained at a definite temperature by circulating cold water outside of the double-structured pipe. The addition point of the sodium behenate solution A and the addition point of the aqueous silver nitrate solution were symmetrically located in both sides of the stirring axis and the height of each position was regulated so that these solutions were not in contact with the liquid reaction mixture.

After the completion of the addition of the sodium behenate solution A, the mixture was allowed so stand at the same temperature for 20 minutes under stirring. Then it was heated to 35° C. over 30 minutes and aged for 210 minutes. Immediately after the completion of the aging, solid matter was filtered off by centrifuging and washed with water until the conductivity of the filtrate amounted 30 $\mu$S/cm. Thus, a fatty acid silver salt was obtained. The solid matter thus obtained was not dried but stored as a wet cake.

When the silver behenate grains thus obtained were evaluated by photographing under an electron microscope, it was found out that these grains were scale-type crystals having average lengths of a=0.14 $\mu$m, b=0.4 $\mu$m and c=0.6 $\mu$m, an average aspect ratio of 5.2, an average grain size as spheres of 0.52 $\mu$m and a coefficient of variation as spheres of 15% (wherein a, b and c are each as defined above).

To the wet cake corresponding to 260 kg of the dry solid matter were added 19.3 kg of polyvinyl alcohol (PVA™-217) and water to give a total amount of 1000 kg. Then the obtained mixture was converted into a slurry with dissolver blades and further pre-dispersed in a pipe line mixer (Model PM-10 manufactured by MIZUHO Industrial Co., Ltd.).

Next, the pre-dispersed feedstock solution was treated thrice in a disperser (Microfluidizer™ M-610, manufactured by Microfluidecs International Corporation, using Z-type interaction chamber) while controlling the pressure to 1260 kg/cm$^2$ to give a silver behenate dispersion. Cooling was carried out by providing coiled heat exchangers back and forth of the interaction chamber and controlling the temperature of the cooling medium to give a dispersion temperature of 18° C.

<<Preparation of Fatty Acid Silver Salt Dispersion B>>

<Preparation of Recrystallized Behenic Acid>

100 kg of behenic acid (Edenor™ C22-85R manufactured by Henkel) was mixed with 1200 kg of isopropyl alcohol, dissolved at 50° C., and then filtered through a 10 $\mu$m filter. Then it was recrystallized by cooling to 30° C. The cooling step for the recrystallization was controlled to 3° C./h. The obtained crystals were centrifuged, washed by pouring 100 kg of isopropyl alcohol and then dried. The obtained crystals were esterified and subjected to GCI-FID measurement. Thus, it was found out that 96% of behenic acid, 2% of lignoceric acid, 2% of arachidic acid and 0.001% of erucic acid were contained therein.

<Preparation of Fatty Acid Silver Salt Dispersion B>

88 kg of the recrystallized behenic acid, 422L of distilled water, 49.2 L of a 5 mol/L aqueous solution of NaOH and 120 L of t-butyl alcohol were mixed together and reacted for 1 hours under stirring at 75° C. to thereby give a sodium behenate solution B. Separately, 206.2 L of an aqueous solution of 40.4 kg of silver nitrate (pH 4.0) was prepared and maintained at 10° C. A reactor containing 635 L of distilled water and 30 L of t-butyl alcohol was maintained at 30° C. Under thoroughly stirring, the whole sodium behenate solution B and the whole aqueous solution of silver nitrate as described above were added thereto at a constant flow rate respectively over 93 minutes and 15 seconds and 90 minutes. In this step, the aqueous silver nitrate solution alone was added within 11 minutes following the initiation of the addition of the aqueous silver nitrate solution and then the addition of the sodium behenate solution B was initiated. Within 14 minutes and 15 seconds following the completion of the addition of the aqueous silver nitrate solution, the sodium behenate solution B alone was added. During this procedure, the reactor was maintained at 30° C. and the external temperature was controlled so that the liquid temperature was maintained at the constant level. The pipe through which the sodium behenate solution B was added was maintained at a definite temperature by circulating warm water outside of the double-structured pipe and the liquid temperature was controlled to 75° C. at the outlet of the front end of the addition nozzle. On the other hand, the pipe through which the aqueous silver nitrate solution was added was maintained at a definite temperature by circulating cold water outside of the double-structured pipe. The addition point of the sodium behenate solution B and the addition point of the aqueous silver nitrate solution were symmetrically located in both sides of the stirring axis and the height of each position was regulated so that these solutions were not in contact with the liquid reaction mixture.

After the completion of the addition of the sodium behenate solution B, the mixture was allowed so stand at the same temperature for 20 minutes under stirring. Then it was heated to 35° C. over 30 minutes and aged for 210 minutes. Immediately after the completion of the aging, solid matter was filtered off by centrifuging and washed with water until the conductivity of the filtrate amounted 30 μS/cm. Thus, a fatty acid silver salt was obtained. The solid matter thus obtained was not dried but stored as a wet cake.

When the silver behenate grains thus obtained were evaluated by photographing under an electron microscope, it was found out that these grains were crystals having average lengths of a=0.21 μm, b=0.4 μm and c=0.4 μm, an average aspect ratio of 2.1 and a coefficient of variation as spheres of 15% (wherein a, b and c are each as defined above).

To the wet cake corresponding to 260 kg of the dry solid matter were added 19.3 kg of polyvinyl alcohol (PVA™-217) and water to give a total amount of 1000 kg. Then the obtained mixture was converted into a slurry with dissolver blades and further pre-dispersed in a pipe line mixer (Model PM-10 manufactured by MIZUHO Industrial Co., Ltd.).

Next, the pre-dispersed feedstock solution was treated thrice in a disperser (Microfluidizer™ M-610, manufactured by Microfluidecs International Corporation, using Z-type interaction chamber) while controlling the pressure to 1150 kg/cm$^2$ to give a silver behenate dispersion. Cooling was carried out by providing coiled heat exchangers back and forth of the interaction chamber and controlling the temperature of the cooling medium to give a dispersion temperature of 18° C.

Preparation of Reducing Agent Dispersion

<<Preparation of Dispersion of Reducing Agent Complex 1>>

To 10 kg of a reducing agent complex 1 (a complex of 6,6'-di-t-butyl-4,4'-dimethyl-2,2'-butylidenediphenol with triphenylphosphine oxide at 1:1), 0.12 kg of triphenylphosphine oxide and 16 kg of a 10% by weight aqueous solution of denatured polyvinyl alcohol (Poval MP203 manufactured by Kuraray Co., Ltd.) was added 10 kg of water and the resultant mixture was mixed well to give a slurry. This slurry was fed with a diaphragm pump and dispersed for 4 hours and 30 minutes in a horizontal sand mill (UVM-2: manufactured by IMEX Co., Ltd.) packed with zirconia beads of 0.5 mm in average diameter. Next, 0.2 g of benzoisothiazolinone sodium salt and water were added thereto to control the concentration of the reducing agent complex to 22% by weight. Thus, a dispersion of the reducing agent complex 1 was obtained. Reducing agent complex grains contained in the reducing agent complex dispersion thus obtained had a median size of 0.45 μm and the maximum grain size of 1.4 m or less. The reducing agent complex dispersion thus obtained was filtered through a polypropylene filter of 3.0 μm in pore size to eliminate contaminants such as dusts and then packed.

<<Preparation of Dispersion of Reducing Agent 2>>

To 10 kg of a reducing agent 2 (6,6'-di-t-butyl-4,4'-dimethyl-2,2'-butylidenediphenol) and 16 kg of a 10% by weight aqueous solution of denatured polyvinyl alcohol (Poval MP203 manufactured by Kuraray Co., Ltd.) was added 10 kg of water and the resultant mixture was mixed well to give a slurry. This slurry was fed with a diaphragm pump and dispersed for 3 hours and 30 minutes in a horizontal sand mill (UVM-2: manufactured by IMEX Co., Ltd.) packed with zirconia beads of 0.5 mm in average diameter. Next, 0.2 g of benzoisothiazolinone sodium salt and water were added thereto to control the concentration of the reducing agent to 25% by weight. The dispersion was heated to 60° C. for 5 hours. Thus, a dispersion of the reducing agent 2 was obtained. Reducing agent grains contained in the reducing agent dispersion thus obtained had a median size of 0.40 μm and the maximum grain size of 1.5 μm or less. The reducing agent dispersion thus obtained was filtered through a polypropylene filter of 3.0 μm in pore size to eliminate contaminants such as dusts and then packed.

<<Preparation of Dispersion of Hydrogen Bond Compound 1>>

To 10 kg of a hydrogen bond compound 1 (tri(4-t-butylphenyl)phosphine oxide) and 16 kg of a 10% by weight aqueous solution of denatured polyvinyl alcohol (Poval MP203 manufactured by Kuraray Co., Ltd.) was added 10 kg of water and the resultant mixture was mixed well to give a slurry. This slurry was fed with a diaphragm pump and dispersed for 3 hours and 30 minutes in a horizontal sand mill (UVM-2: manufactured by IMEX Co., Ltd.) packed with zirconia beads of 0.5 mm in average diameter. Next, 0.2 g of benzoisothiazolinone sodium salt and water were added thereto to control the concentration of the hydrogen bond compound to 25% by weight. The dispersion was heated to 80° C. for 1 hour. Thus, a dispersion of the hydrogen bond compound 1 was obtained. Hydrogen bond compound grains contained in the hydrogen bond compound dispersion thus obtained had a median size of 0.35 μm and the maximum grain size of 1.5 μm or less. The hydrogen bond compound dispersion thus obtained was filtered through a polypropylene filter of 3.0 μm in pore size to eliminate contaminants such as dusts and then packed.

<<Preparation of Dispersion of Development Accelerator 1>>

To 10 kg of a development accelerator 1 (the structural formula of which will be shown hereinafter) and 20 kg of a 10% by weight aqueous solution of denatured polyvinyl alcohol (Poval MP203 manufactured by Kuraray Co., Ltd.) was added 10 kg of water and the resultant mixture was mixed well to give a slurry. This slurry was fed with a diaphragm pump and dispersed for 3 hours and 30 minutes in a horizontal sand mill (UVM-2: manufactured by IMEX Co., Ltd.) packed with zirconia beads of 0.5 nm in average diameter. Next, 0.2 g of benzoisothiazolinone sodium salt and water were added thereto to control the concentration of the development accelerator to 20% by weight. Thus, a dispersion of the development accelerator 1 was obtained. Development accelerator grains contained in the development accelerator dispersion thus obtained had a median size of 0.48 μm and the maximum grain size of 1.4 μm or less. The development accelerator dispersion thus obtained was filtered through a polypropylene filter of 3.0 μm in pore size to eliminate contaminants such as dusts and then packed.

Solid dispersions of a development accelerator 2 and a color tone controller 1 (the formulae thereof will be shown hereinafter) were prepared by dispersing as in the case of the development accelerator 1 to give 20% by weight dispersions respectively.

Preparation of Polyhalogen Compound

<<Preparation of Dispersion of Organic Polyhalogen Compound 1>>

10 kg of an organic polyhalogen compound 1 (tribromomethanesulfonylbenzene), 10 kg of a 10% by weight aqueous solution of denatured polyvinyl alcohol (Poval MP203 manufactured by Kuraray Co., Ltd.), 0.4 kg of a 20% by weight aqueous solution of sodium triisopropylnaphthalenesulfonate and 14 kg of water were mixed well to give a slurry. This slurry was fed with a diaphragm pump and dispersed for 5 hours in a horizontal sand mill (UVM-2: manufactured by IMEX Co., Ltd.) packed with zirconia beads of 0.5 mm in average diameter. Next, 0.2 g of benzoisothiazolinone sodium salt and water were added thereto to control the concentration of the organic polyhalogen compound to 26% by weight. Thus, a dispersion of the organic polyhalogen compound 1 was obtained. Organic polyhalogen compound grains contained in the organic polyhalogen compound dispersion thus obtained had a median size of 0.41 μm and the maximum grain size of 2.0 μm or less. The organic polyhalogen compound dispersion thus obtained was filtered through a polypropylene filter of 10.0 μm in pore size to eliminate contaminants such as dusts and then packed.

<<Preparation of Dispersion of Organic Polyhalogen Compound 2>>

10 kg of an organic polyhalogen compound 2 (N-butyl-3-tribromomethanesulfonylbenzamide), 20 kg of a 10% by weight aqueous solution of denatured polyvinyl alcohol (Poval MP203 manufactured by Kuraray Co., Ltd.) and 0.4 kg of a 20% by weight aqueous solution of sodium triisopropylnaphthalenesulfonate were mixed well to give a slurry. This slurry was fed with a diaphragm pump and dispersed for 5 hours in a horizontal sand mill (UVM-2: manufactured by IMEX Co., Ltd.) packed with zirconia beads of 0.5 mm in average diameter. Next, 0.2 g of benzoisothiazolinone sodium salt and water were added thereto to control the concentration of the organic polyhalogen compound to 30% by weight. Thus, a dispersion of the organic polyhalogen compound 2 was obtained. Organic polyhalogen compound grains contained in the organic polyhalogen compound dispersion thus obtained had a median size of 0.40 μm and the maximum grain size of 1.3 μm or less. The organic polyhalogen compound dispersion thus obtained was filtered through a polypropylene filter of 3.0 μm in pore size to eliminate contaminants such as dusts and then packed.

<<Preparation of Solution of Phthalazine Compound 1>>

8 kg of denatured polyvinyl alcohol MP203 manufactured by Kuraray Co., Ltd. was dissolved in 174.57 kg of water. Next, 3.15 kg of a 20% by weight aqueous solution of sodium triisopropylnaphthalenesulfonate and 14.28 kg of a 70% by weight aqueous solution of a phthalazine compound 1 (6-isopropylphthalazine) were added thereto to give a 5% by weight solution of the phthalazine compound 1.

Preparation of Mercapto Compound

<<Preparation of Aqueous Solution of Mercapto Compound 1>>

7 g of a mercapto compound 1(1-(3-sulfophenyl)-5-mercaptotetrazole sodium salt) was dissolved in 993 g of water to give a 0.7% by weight aqueous solution.

<<Preparation of Aqueous Solution of Mercapto Compound 2>>

20 g of a mercapto compound 2(1-(3-methylureido)-5-mercaptotetrazole sodium salt) was dissolved in 980 g of water to give a 2.0% by weight aqueous solution.

<<Preparation of Dispersion of Pigment 1>>

64 g of C.I. Pigment Blue 60 and 6.4 g of Demol N manufactured by Kao Corporation were added to 250 g of water and mixed well to give a slurry. 800 g of zirconia beads having an average diameter of 0.5 mm were prepared and fed into a vessel together with the slurry. Then the mixture was dispersed in a disperser (¼ Sand Grinder Mill: manufactured by IMEX) for 25 hours to give a dispersion of the pigment 1. Pigment grains contained in the pigment dispersion thus obtained had an average grain size of 0.21 μm.

<<Preparation of SBR Latex>>

An SBR latex was prepared in the following manner.

Into a polymerization pot of a gas monomer reaction apparatus (Model TAS-2J manufactured by Taiatsu Techno Corporation) were introduced 287 g of distilled water, 7.73 g of a surfactant (Paionin A-43-S manufactured by Takemoto Oil & Fat Co., Ltd., solid content 48.5%), 14.06 mol of 1 mol/L NaOH, 0.15 g of tetrasodium ethylenediaminetetraacetate, 255 g of styrene, 11.25 g of acrylic acid and 3.0 g of tert-dodecylmercaptane. After sealing the reactor, the mixture was stirred at 200 rpm. Then the reactor was degassed with a vacuum pump and purged with nitrogen gas several times. Next, 108.75 g of 1,3-butadiene was pressed thereinto and the inner temperature was elevated to 60° C. Next, a solution of 1.875 g of ammonium persulfate dissolved in 50 ml of water was added thereto and the resultant mixture was stirred as such for 5 hours. Then it was heated to 90° C. and stirred for additional 3 hours. After the completion of the reaction, the mixture was cooled until the inner temperature was lowered to room temperature. Then 1 mol/L NaOH and $NH_4OH$ were added so as to give a molar ratio of $Na^+$ ion:$NH_4^+$ ion of 1:5.3. After adjusting the mixture to pH 8.4, it was filtered through a polypropylene filter of 1.0 μm in pore size to eliminate contaminants such as dusts and packed. Thus, 774.7 g of an SBR latex was obtained. The chloride ion concentration determined by halogen ion measurement by ion chromatography was 3 ppm. The chelating agent concentration determined by high-performance liquid chromatography was 145 ppm.

This latex had an average grain size of 90 nm, Tg=17° C., a solid content of 44% by weight, an equilibrated water content at 25° C. and 60%RH of 0.6% by weight, an ion conductivity of 4.80 mS/cm (the ion conductivity was determined with a conductivity meter CM-30S manufactured by DKK-TOA corporation by using the feedstock latex (44% by weight)), and pH 8.4.

SBR latexes having different Tg's can be prepared in the same manner but appropriately altering the styrene/butadiene ratio.

<<Preparation of Coating Solution 1 for Emulsion Layer (Photosensitive Layer)>>

1000 g of the fatty acid silver salt dispersion A, 276 ml of water, 33 g of the dispersion of the pigment 1, 21 g of the dispersion of the organic polyhalogen compound 1, 58 g of the dispersion of the organic polyhalogen compound 2, 173 g of the solution of the phthalazine compound 1, 1082 g of the SBR latex (Tg: 17° C.), 299 g of the dispersion of the reducing complex 1, 5.7 g of the dispersion of the development accelerator 1, 9 ml of the aqueous solution of the mercapto compound 1 and 27 ml of the aqueous solution of the mercapto compound 2, each obtained above, were successively added. Immediately before the coating, 117 g of the mixed silver halide emulsion A was added thereto followed by mixing well. The thus obtained coating solution for emulsion layer was fed as such to a coating die and then coated.

When measured with a Brookfield viscometer manufactured by Tokyo Keiki, the coating solution for emulsion layer as described above had a viscosity of 25 [mPa·s] at 40° C. (No. 1 rotor, 60 rpm).

When measured with the use of an RFS fluid spectrometer manufactured by Rheometrics Far East, the viscosities at 25° C. of the coating solution were 230, 60, 46, 24 and 18 [mPa·s] respectively at shear speeds of 0.1, 1.10, 100 and 1000 [1/sec].

The zirconium content in the coating solution was 0.38 mg per gram of silver.

<<Preparation of Coating Solution 2 for Emulsion Layer (Photosensitive Layer)>>

1000 g of the fatty acid silver salt dispersion B, 276 ml of water, 35 g of the dispersion of the pigment 1, 32 g of the dispersion of the organic polyhalogen compound 1, 46 g of the dispersion of the organic polyhalogen compound 2, 173 g of the solution of the phthalazine compound 1, 1082 g of the SBR latex (Tg: 17° C.), 153 g of the dispersion of the reducing agent 2, 55 g of the dispersion of the hydrogen bond compound 1, 4.8 g of the dispersion of the development accelerator 1, 5.2 g of the dispersion of the development accelerator 2, 2.1 g of the dispersion of the color tone controller 1 and 8 ml of the aqueous solution of the mercapto compound 1, each obtained above, were successively added. Immediately before the coating, 140 g of the mixed silver halide emulsion A was added thereto followed by mixing well. The thus obtained coating solution for emulsion layer was fed as such to a coating die and then coated.

When measured with a Brookfield viscometer manufactured by Tokyo Keiki, the coating solution for emulsion layer as described above had a viscosity of 40 [mPa·s] at 40° C. (No. 1 rotor, 60 rpm).

When measured with the use of an RFS fluid spectrometer manufactured by Rheometrics Far East, the viscosities at 25° C. of the coating solution were 530, 144, 96, 51 and 28 [mPa·s] respectively at shear speeds of 0.1, 1.10, 100 and 1000 [1/sec].

The zirconium content in the coating solution was 0.25 mg per gram of silver.

<<Preparation of Coating Solution for Intermediate Layer in Emulsion Face>>

To 1000 g of polyvinyl alcohol PVA-205 (manufactured by Kuraray Co., Ltd.), 272 g of a 5% by weight pigment dispersion and 4200 ml of a 19% by weight latex of a methyl methacrylate/styrene/butyl acrylate/hydroxyethyl methacrylate/acrylic acid copolymer (copolymerization ratio by weight 64/9/20/5/2) were added 27 ml of a 5% by weight aqueous solution of Aerosol OT (manufactured by American Cyanamid), 135 ml of a 20% by weight aqueous solution of diammonium phthalate and water in such an amount as giving a total amount of 10000 g. Then the resultant mixture was adjusted to pH 7.5 with NaOH to give a coating solution for intermediate layer. Next, it was fed into a coating die to give a dose of 9.1 ml/m$^2$.

When measured with a Brookfield viscometer, the coating solution had a viscosity of 58 [mPa·s] at 40° C. (No. 1 rotor, 60 rpm).

<<Preparation of Coating Solution for First Layer of Protective Layer in Emulsion Face>>

64 g of inert gelatin was dissolved in water. Then, 112 g of a 19% by weight latex of a methyl methacrylate/styrene/butyl acrylate/hydroxyethyl methacrylate/acrylic acid copolymer (copolymerization ratio by weight 64/9/20/5/2), 30 ml of a 15% by weight solution of phthalic acid in methanol, 23 ml of a 10% by weight aqueous solution of 4-methylphthalic acid, 28 ml of a 0.5 mol/L sulfuric acid, 5 ml of a 5% by weight aqueous solution of Aerosol OT (manufactured by American Cyanamid), 0.5 g of phenoxy ethanol and 0.1 g of benzoisothiazolinone were added thereto. After adding water to give a total amount of 750 g, a coating solution was obtained. Immediately before the coating, 26 ml of 4% by weight chrome alum was mixed with a static mixer and the resultant mixture was fed into a coating die to give a dose of 18.6 ml/m$^2$.

When measured with a Brookfield viscometer, the coating solution had a viscosity of 20 [mPa·s] at 40° C. (No. 1 rotor, 60 rpm).

<<Preparation of Coating Solution for Second Layer of Protective Layer in Emulsion Face>>

80 g of inert gelatin was dissolved in water. Then, 102 g of a 27.5% by weight latex of a methyl methacrylate/styrene/butyl acrylate/hydroxyethyl methacrylate/acrylic acid copolymer (copolymerization ratio by weight 64/9/20/5/2), 5.4 ml of a 2% by weight solution of the fluorine-based surfactant (SF-1), 5.4 ml of a 2% by weight aqueous solution of the fluorine-based surfactant (SF-2), 23 ml of a 5% by weight aqueous solution of Aerosol OT (manufactured by American Cyanamid), 4 g of fine polymethyl methacrylate grains (average grain size 0.7 $\mu$m), 21 g of fine polymethyl methacrylate grains (average grain size 4.5 $\mu$m), 1.6 g of 4-methylphthalic acid, 4.8 g of phthalic acid, 44 ml of 0.5 mol/L sulfuric acid, 10 mg of benzoisothiazolinone and water in such an amount as giving a total amount of 650 g were added thereto. Immediately before the coating, 445 ml of an aqueous solution containing 4% by weight chrome alum and 0.67% by weight of phthalic acid was mixed with a static mixer to give a coating solution for surface protective layer. The obtained coating solution was fed into a coating die to give a dose of 8.3 ml/m$^2$.

When measured with a Brookfield viscometer, the coating solution had a viscosity of 19 [mPa·s] at 40° C. (No. 1 rotor, 60 rpm).

<<Production of Photothermographic Material 1>>

The back face side of the undercoated substrate as described above was double-coated simultaneously with the coating solution for antihalation layer to give a gelatin coating dose of 0.44 g/m$^2$ and the coating solution for protective layer in back face to give a gelatin coating dose of 1.7 g/m$^2$ followed by drying, thereby forming a back layer.

The face opposite to the back face was multi-coated simultaneously with the emulsion layer, the intermediate layer, the first protective layer and the second protective layer in this order starting with the undercoated face by the slide bead coating method, thereby forming a photothermographic material sample. In this step, the emulsion layer and the intermediate layer were controlled at 31° C., while the first protective layer and the second protective layer were controlled respectively at 36° C. and 37° C.

The coating doses (g/m$^2$) of the compounds contained in the emulsion layer were as follows.

| | |
|---|---|
| Silver behenate | 5.58 |
| Pigment (C.I. Pigment Blue 60) | 0.036 |
| Polyhalogen compound 1 | 0.12 |
| Polyhalogen compound 2 | 0.37 |
| Phthalazine compound 1 | 0.19 |
| SBR latex | 9.98 |
| Reducing agent complex 1 | 1.41 |
| Development accelerator 1 | 0.025 |
| Mercapto compound 1 | 0.002 |
| Mercapto compound 2 | 0.012 |
| Silver halide (as Ag) | 0.091 |

The coating and drying were carried out under the following conditions.

Coating was performed at a speed of 160 m/min. The gap between the front end of the coating die and the substrate was adjusted to 0.10 to 0.30 mm and the pressure in the vacuum chamber was lowered by 196 to 882 Pa compared with the atmospheric pressure. The substrate was destaticized under an ion stream before the coating.

In the subsequent chilling zone, the coating solution was chilled under an air flow at a dry bulb temperature of 10 to 20° C. and then transported in a non-contact manner. Then it was cooled in a coiled non-contact type dryer under a drying air stream at a dry bulb temperature of 23 to 45° C. and a wet bulb temperature of 15 to 21° C.

After conditioning at 25° C. under 40 to 60% RH, the film face was heated to 70 to 90° C. After heating, the film face was cooled to 25° C.

The degree of mattness of the photothermographic material thus produced expressed in Bekk smoothness was 550 sec in the photosensitive layer side and 130 sec in the back face. The film face pH in the photosensitive layer was 6.0.

<<Production of Photothermographic Material 2>>

A photothermographic material 2 was produced as in the photothermographic material 1 but changing the coating solution 1 for emulsion layer to the coating solution 2 for emulsion layer, using no yellow dye compound 1 in the antihalation layer, and changing the fluorine-based surfactants SF-1 and SF-2 in the emulsion face protective layer respectively to SF-3 and SF-4 (the formulae of which will be shown hereinafter).

The coating doses (g/m$^2$) of the compounds contained in the emulsion layer were as follows.

| | |
|---|---|
| Silver behenate | 5.27 |
| Pigment (C.I. Pigment Blue 60) | 0.036 |
| Polyhalogen compound 1 | 0.17 |
| Polyhalogen compound 2 | 0.28 |
| Phthalazine compound 1 | 0.18 |
| SBR latex | 9.43 |
| Reducing agent 2 | 0.77 |
| Hydrogen bond compound 1 | 0.28 |
| Development accelerator 1 | 0.019 |

-continued

| | |
|---|---|
| Development accelerator 2 | 0.020 |
| Color tone controller | 0.008 |
| Mercapto compound 2 | 0.003 |
| Silver halide (as Ag) | 0.091 |

Next, the structural formulae of the compounds employed in the above Examples will be given.

Spectral sensitizing dye A

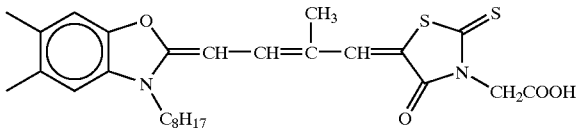

Spectral sensitizing dye B

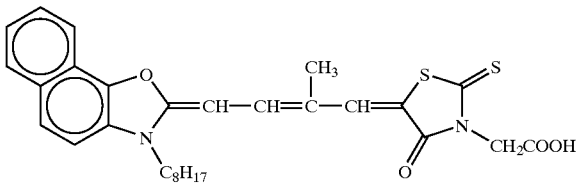

Tellurium sensitizer C

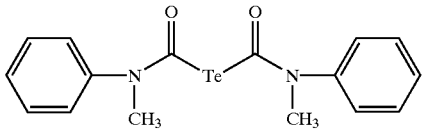

Base precursor compound 1

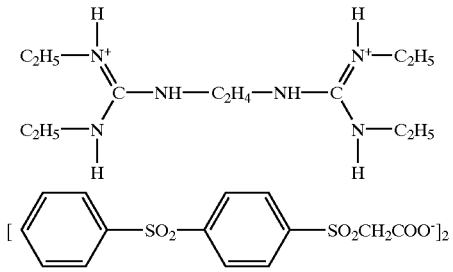

Cyanine dye compound 1

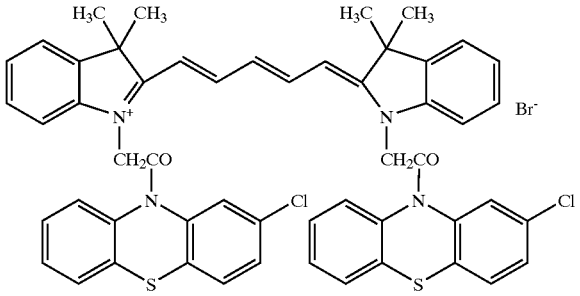

-continued
Blue dye compound 1
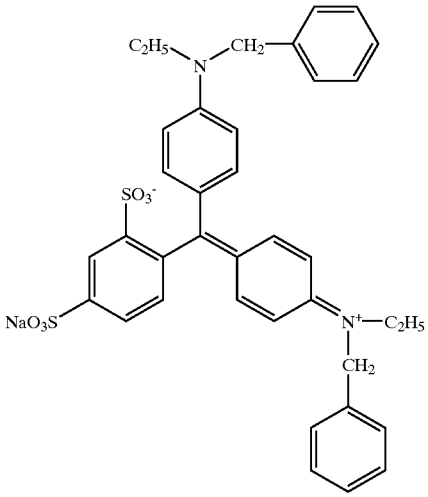
Yellow dye compound 1
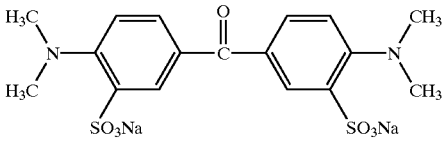
(Reducing agent complex 1)
1:1 complex of
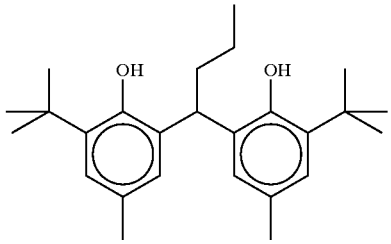
and
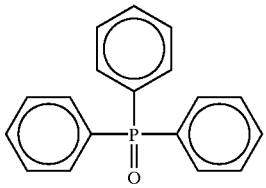
(Reducing agent 2)
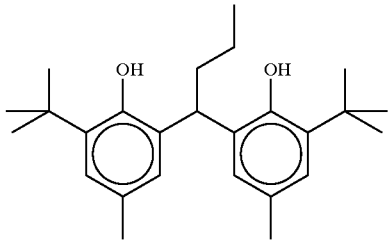
-continued
(Hydrogen bond compound 1)
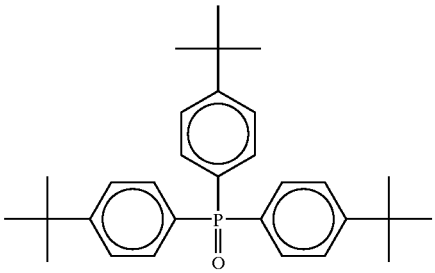
(Polyhalogen compound 1)
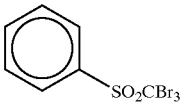
(Polyhalogen compound 2)
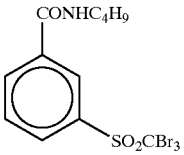
(Mercapto compound 1)
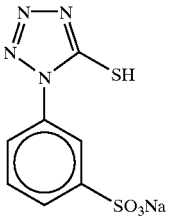
(Mercapto compound 2)
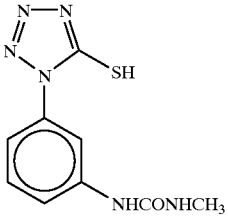
(Phthalazine compound 1)
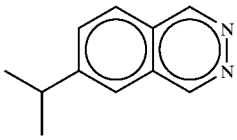
(Development accelerator 1)
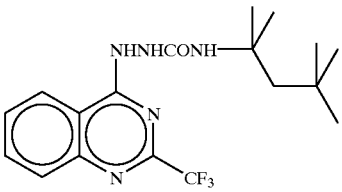

-continued (Development accelerator 2)

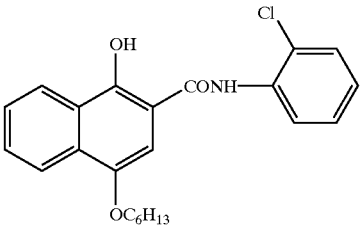

(Color tone controller 1)

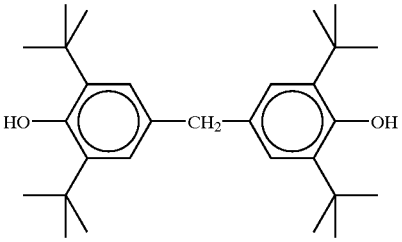

(SF-1)

$CF_3(CF_2)nCH_2CH_2SCH_2CH_2COOLi$ mixture of n = 7 to 11

(SF-2)

$CF_3(CF_2)nCH_2CH_2O(CH_2CH_2O)mH$ mixture of n = 7 to 11, m = 5 to 15

(SF-3)

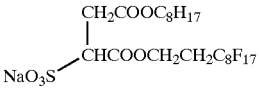

(SF-4)

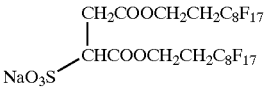

Example 1

Photothermographic materials 001 to 020 were produced as in the photothermographic material 1 but replacing the fatty acid compositions of the organic silver salts of the photothermographic material 1 by those listed in Tables 1 and 2 and employing different fluorine compounds specified in the invention in the same amount in the emulsion protective layer 2 and the back face protective layer as shown in Table 2.

TABLE 1

| | Fatty acid composition (% by mol) | | | | |
|---|---|---|---|---|---|
| Organic silver salt | Behenic acid | Lignoceric acid | Arachidic acid | Stearic acid | Remarks |
| A | 90% | 2% | 6% | 2% | Invention |
| B | 96% | 2% | 2% | 0% | Invention |
| B-1 | 99% | 0.5% | 0.5% | 0% | Comparison |
| B-2 | 97% | 1% | 1% | 1% | Invention |
| B-3 | 92% | 2% | 4% | 2% | Invention |
| B-4 | 88% | 4% | 5% | 3% | Invention |
| B-5 | 80% | 5% | 8% | 7% | Invention (in preferable range) |
| B-6 | 65% | 4% | 18% | 13% | Invention (in preferable range) |
| B-7 | 55% | 3% | 25% | 17% | Invention (in preferable range) |
| B-8 | 45% | 2% | 28% | 25% | Invention |
| B-9 | 35% | 5% | 30% | 30% | Comparison |

TABLE 2

| Sample no. | Organic silver salt | Flourine compound | Maximum density Dmax | Relative sensitivity ΔS | Change in sensitivity with time ΔS1 | Change in sensitivity under using ΔS2 | Remarks |
|---|---|---|---|---|---|---|---|
| 001 | A | SF-1/SF-2 | 3.88 | 0 (standard) | +0.02 | 0.10 | Comparison |
| 002 | A | F-17 | 3.89 | +0.01 | −0.02 | 0.05 | Invention |
| 003 | B-1 | SF-1/SF-2 | 3.56 | −0.08 | −0.18 | 0.14 | Comparison |
| 004 | B-1 | F-17 | 3.45 | −0.11 | −0.22 | 0.12 | Comparison |
| 005 | B-2 | SF-1/SF-2 | 3.78 | −0.03 | −0.11 | 0.13 | Comparison |
| 006 | B-2 | F-17 | 3.80 | −0.02 | −0.05 | 0.07 | Invention |
| 007 | B-3 | SF-1/SF-2 | 3.90 | +0.01 | +0.05 | 0.12 | Comparison |
| 008 | B-3 | F-17 | 3.90 | +0.01 | −0.03 | 0.05 | Invention |
| 009 | B-4 | SF-1/SF-2 | 3.95 | +0.04 | +0.08 | 0.10 | Comparison |
| 010 | B-4 | F−17 | 3.94 | +0.05 | −0.02 | 0.05 | Invention |
| 011 | B-5 | SF-1/SF-2 | 4.02 | +0.09 | +0.11 | 0.09 | Comparison |
| 012 | B-5 | F−17 | 4.03 | +0.08 | +0.00 | 0.02 | Invention (in preferable range) |
| 013 | B-6 | SF-1/SF-2 | 4.06 | +0.12 | +0.13 | 0.08 | Comparison |
| 014 | B-6 | F-17 | 4.05 | +0.12 | +0.01 | 0.03 | Invention (in preferable range) |

TABLE 2-continued

| Sample no. | Organic silver salt | Flourine compound | Maximum density Dmax | Relative sensitivity ΔS | Change in sensitivity with time ΔS1 | Change in sensitivity under using ΔS2 | Remarks |
|---|---|---|---|---|---|---|---|
| 015 | B-7 | SF-1/SF-2 | 4.08 | +0.15 | +0.14 | 0.07 | Comparison |
| 016 | B-7 | F−17 | 4.09 | +0.14 | +0.03 | 0.04 | Invention (in preferable range) |
| 017 | B-8 | SF-1/SF-2 | 4.05 | +0.16 | +0.15 | 0.10 | Comparison |
| 018 | B-8 | F-17 | 4.03 | +0.13 | +0.07 | 0.06 | Invention |
| 019 | B-9 | SF-1/SF-2 | 3.64 | −0.03 | +0.21 | 0.14 | Comparison |
| 020 | B-9 | F−17 | 3.60 | −0.11 | +0.14 | 0.13 | Comparison |

Evaluation of Photographic Performance

Each sample thus obtained was cut into the half size and packaged in the following packaging material at 25° C. under 40% RH. After storing at ordinary temperature for 2 weeks, it was evaluated as follows.

Packaging Material

PET 10μ/PW 12μ/aluminum foil 9μ/3% carbon-containing polyethylene 50μ. Oxygen permeability: 0.2 ml/atm·$m^2$·25° C.·day. Moisture permeability: 0.10 g/atm·$m^2$·25° C.·day.

Each sample was stored for additional 7 days at 25° C. and 40% and at 30° C. and 70%. Then it was exposed and thermally developed (for 24 seconds in total using 4 panel heaters respectively set to 112° C.-119° C.-121° C.-121° C.) with the use of a Fuji Medical Dry Imager FM-DP L (having a 660 nm semiconductor laser column of a maximum output of 60 mW (IIIB)) having been held at 25° C. and 55%. Then the obtained images were evaluated with a densitometer.

The image density was determined by measuring the maximum image density (Dmax) achieved by exposing at the maximum laser output. Concerning the sensitivity, the relative sensitivity (ΔS) of the sample stored at 25° C. and 40% to the photothermographic material 1 was measured.

A change in the sensitivity between the sample stored at 30° C. and 70% and the one stored at 25° C. and 40% was referred to as ΔS1.

Further, the sample stored at 25° C. and 40% was processed with the above-described developing machine under environmental conditions of 15° C. and 15%, 25° C. and 15%, 25° C. and 50%, 25° C. and 80%, 30° C. and 40% and 30° C. and 70%. Then the change in the sensitivity between 2 conditions showing the largest change was referred to as ΔS2.

The thus determined Dmax, ΔS, ΔS1 and ΔS2 are listed in Table 2.

As Table 2 indicates, the change in sensitivity ΔS1 stored under different conditions and the change in sensitivity ΔS2 developed under different environmental conditions could be lessened by the combined use of the organic silver salts containing from 40 to 98% of behenic acid according to the invention and the fluorine compounds according to the invention.

In particular, it is preferable to use organic silver salts containing from 50 to 85% of behenic acid, since a high density and a high sensitivity could be thus established.

Example 2

Photothermographic materials 101 to 120 were produced as in the photothermographic material 2 but replacing the fatty acid compositions of the organic silver salts of the photothermographic material 2 by those listed in Tables 1 and 3 and employing different fluorine compounds specified in the invention in the same amount in the emulsion protective layer 2 and the back face protective layer as shown in Table 3.

TABLE 3

| Sample no. | Organic silver salt | Flourine compound | Maximum density Dmax | Relative sensitivity ΔS | Change in sensitivity with time ΔS1 | Change in sensitivity under using ΔS2 | Remarks |
|---|---|---|---|---|---|---|---|
| 101 | B | SF-3/SF-4 | 3.90 | 0 (standard) | +0.05 | 0.12 | Comparison |
| 102 | B | F-1 | 3.92 | +0.01 | −0.01 | 0.06 | Invention |
| 103 | B | F-3 | 3.94 | +0.02 | −0.02 | 0.06 | Invention |
| 104 | B | F-6 | 3.91 | +0.01 | 0.00 | 0.07 | Invention |
| 105 | B | F-13 | 3.93 | +0.03 | −0.01 | 0.05 | Invention |
| 106 | B | F-14 | 3.92 | +0.02 | +0.01 | 0.05 | Invention |
| 107 | B | F-15 | 3.89 | +0.02 | −0.01 | 0.06 | Invention |
| 108 | B | F-17 | 3.94 | +0.01 | −0.02 | 0.04 | Invention |
| 109 | B | F-29 | 3.93 | +0.03 | +0.02 | 0.04 | Invention |
| 110 | B | F-41 | 3.91 | +0.02 | −0.02 | 0.06 | Invention |
| 111 | B-6 | SF-3/SF-4 | 4.00 | +0.09 | +0.14 | 0.16 | Comparison |
| 112 | B-6 | F-5 | 4.02 | +0.10 | +0.03 | 0.08 | Invention |
| 113 | B-6 | F-8 | 4.04 | +0.12 | +0.02 | 0.09 | Invention |
| 114 | B-6 | F-15 | 4.03 | +0.11 | +0.03 | 0.06 | Invention |

TABLE 3-continued

| Sample no. | Organic silver salt | Flourine compound | Maximum density Dmax | Relative sensitivity ΔS | Change in sensitivity with time ΔS1 | Change in sensitivity under using ΔS2 | Remarks |
|---|---|---|---|---|---|---|---|
| 115 | B-6 | F-16 | 4.02 | +0.13 | +0.01 | 0.07 | Invention |
| 116 | B-6 | F-17 | 4.00 | +0.12 | +0.02 | 0.06 | Invention |
| 117 | B-6 | F-25 | 4.05 | +0.11 | +0.3 | 0.05 | Invention |
| 118 | B-6 | F-26 | 4.03 | +0.13 | +0.02 | 0.05 | Invention |
| 119 | B-6 | F-33 | 4.03 | +0.12 | +0.01 | 0.04 | Invention |
| 120 | B-6 | F-34 | 4.01 | +0.11 | +0.02 | 0.04 | Invention |

These photothermographic materials were also evaluated as in Example 1 but the thermal development was performed for 14 seconds.

In this case, ΔS1 and ΔS2 could be also lessened by the combined use of the organic silver salts and the fluorine compounds as specified in the invention similar to Example 1.

Example 3

Photothermographic materials 201 to 220 were produced as in the photothermographic material 2 but replacing the fatty acid compositions of the organic silver salts of the photothermographic material 2 by those listed in Tables 1 and 4, employing different fluorine compounds specified in the invention in the emulsion protective layer 2 and the back face protective layer as shown in Table 4, and using different compounds as the reducing agents and the antifogging agents as listed in Table 4. In the photothermographic materials with the use of R-1 and R-2, however, the coating doses of the reducing agents were respectively 1.35 and 1.25 times by mol as much as in the photothermographic material 2.

TABLE 4

| Sample no. | Organic silver salt | Fluorine compound | Reducing agent | Antifogging agent | Change in sensitivity with time ΔS1 | Change in sensitivity under using ΔS2 | Remarks |
|---|---|---|---|---|---|---|---|
| 201 | B-4 | — | R-1 | H-1/H-8 | +0.08 | 0.14 | Comparison |
| 202 | B-4 | F-29 | R-1 | H-1/H-8 | +0.02 | 0.07 | Invention |
| 203 | B-4 | — | R-2 | H-1/H-8 | +0.10 | 0.13 | Comparison |
| 204 | B-4 | F-29 | R-2 | H-1/H-8 | +0.1 | 0.08 | Invention |
| 205 | B-4 | — | R-4 | H-1/H-8 | +0.09 | 0.16 | Comparison |
| 206 | B-4 | F-29 | R-4 | H-1/H-8 | +0.01 | 0.06 | Invention |
| 207 | B-4 | — | R-6 | H-1/H-8 | +0.08 | 0.14 | Comparison |
| 208 | B-4 | F-29 | R-6 | H-1/H-8 | +0.03 | 0.06 | Invention |
| 209 | B-4 | — | R-9 | H-1/H-8 | +0.10 | 0.15 | Comparison |
| 210 | B-4 | F-29 | R-9 | H-1/H-8 | +0.02 | 0.07 | Invention |
| 211 | B-7 | — | R-1 | H-1/H-8 | +0.19 | 0.21 | Comparison |
| 212 | B-7 | F-25 | R-1 | H-1/H-8 | +0.03 | 0.08 | Invention |
| 213 | B-7 | — | R-1 | H-3 | +0.18 | 0.19 | Comparison |
| 214 | B-7 | F-25 | R-1 | H-3 | +0.03 | 0.05 | Invention |
| 215 | B-7 | — | R-1 | H-4 | +0.18 | 0.18 | Comparison |
| 216 | B-7 | F-25 | R-1 | H-4 | +0.02 | 0.04 | Invention |
| 217 | B-7 | — | R-2 | H-3 | +0.17 | 0.19 | Comparison |
| 218 | B-7 | F-25 | R-2 | H-3 | +0.04 | 0.04 | Invention |
| 219 | B-7 | — | R-2 | H-4 | +0.16 | 0.17 | Comparison |
| 220 | B-7 | F-25 | R-2 | H-4 | +0.03 | 0.05 | Invention |

These photothermographic materials were also evaluated as in Example 2. In this case, ΔS1 and ΔS2 could be also lessened by the combined use of the organic silver salts and the fluorine compounds as specified in the invention similar to Example 2.

Example 4

Photothermographic materials 301 to 309 were produced as in the photothermographic material 2 but employing different fluorine compounds specified in the invention in the emulsion protective layer 2 and the back face protective layer as shown in Table 5, and using the fluorine compounds specified in the invention in the undercoating layer in an amount of ⅓ times by weight as much as polyethylene glycol monononylphenyl ether as shown in Table 5.

;l

TABLE 5

| Sample no. | Organic silver salt | Fluorine compound | Fluorine compound in undercoating layer | Change in sensitivity with time ΔS1 | Change in sensitivity under using ΔS2 | Remarks |
|---|---|---|---|---|---|---|
| 31 | B | SF-3/SF-4 | — | +0.05 | 0.12 | Comparison |
| 302 | B | F-17 | — | −0.02 | 0.04 | Invention |
| 303 | B | F-29 | — | +0.02 | 0.04 | Invention |
| 304 | B | SF-3/SF4 | F-17 | +0.03 | 0.06 | Invention |
| 305 | B | SF-3/SF-4 | F-29 | +0.03 | 0.05 | Invention |
| 306 | B | F-17 | F-17 | +0.01 | 0.03 | Invention |
| 307 | B | F-17 | F-29 | +0.01 | 0.03 | Invention |
| 308 | B | F-29 | F-17 | +0.01 | 0.03 | Invention |
| 309 | B | F-29 | F-29 | +0.01 | 0.02 | Invention |

These photothermographic materials were also evaluated as in Example 3. In this case, ΔS1 and ΔS2 could be also lessened by the combined use of the organic silver salts and the fluorine compounds as specified in the invention similar to Example 2. Moreover, it can be understood that the specific fluorine compounds of the invention contained in the undercoating layer were also effective in lessening ΔS1 and ΔS2. That is to say, the effects of the invention can be achieved by adding these compounds to any layer. Furthermore, it can be understood that ΔS1 and ΔS2 could be still lessened by adding these compounds to both of the back layer and the undercoating layer.

Further, samples 401 to 409 were produced as in the samples 301 to 309 but using no polyethylene glycol monononylphenyl ether.

It was also confirmed in this case that ΔS1 and ΔS2 could be lessened by the combined use of the organic silver salts and the fluorine compounds specified in the invention similar to Example 2.

Example 5

Samples 501 to 520 were produced as in samples 101 to 120 in Example 1 but using neither the developing accelerator 2 nor the color tone controller 1. These samples were evaluated as in Example 1. As a result, it was also confirmed in this case that the change in the sensitivity (ΔS1) stored under different conditions and the change in the sensitivity (ΔS2) developed under different environmental conditions could be lessened by the combined use of the organic silver salts and the fluorine compounds specified in the invention.

According to the invention, it is possible to provide a photothermographic material which shows a lessened change in photographic performance during storage and a lessened change in photographic performance depending on environmental temperature/humidity conditions in using and thus has a favorable photographic performance.

This application is based on Japanese Patent application JP 2002-113351, filed Apr. 16, 2002, the entire content of which is hereby incorporated by reference, the same as if set forth at length.

What is claimed is:

1. A photothermographic material comprising:

a substrate; and a photosensitive silver halide, a non-photosensitive organic silver salt, a reducing agent and a binder, in one side defined by the substrate, wherein the photothermographic material further comprises a fluorine compound which comprises at least one fluoroalkyl group having 2 or more of carbon atoms and not more than 13 of fluorine atoms and at least one of anionic and nonionic hydrophilic groups, and 40 to 98% by mol of the non-photosensitive organic silver salts are silver behenate.

2. The photothermographic material according to claim 1, wherein the fluorine compound is a compound represented by the following formula (F):

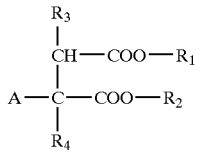

(F)

wherein $R^1$ and $R^2$ each represents a substituted or unsubstituted alkyl group and at least one of $R^1$ and $R^2$ represents a fluoroalkyl group having 2 or more of carbon atoms and not more than 13 of fluorine atoms; $R^3$ and $R^4$ each represents a hydrogen atom or an alkyl group; and A represents $—L_b—SO_3—M$, M represents a hydrogen atom or a cation, and $L_b$ represents a single bond or a substituted or unsubstituted alkylene group.

3. The photothermographic material according to claim 2, wherein both of $R^3$ and $R^4$ represent a hydrogen atom.

4. The photothermographic material according to claim 2, wherein $L_b$ represents $—CH_2—$.

5. The photothermographic material according to claim 2, wherein at least one of $R^1$ and $R^2$ represents a fluoroalkyl group having 4 or more of carbon atoms and not more than 11 of fluorine atoms.

6. The photothermographic material according to claim 2, wherein $R^1$ and $R^2$ each represents a fluoroalkyl group having 4 or more of carbon atoms and not more than 11 of fluorine atoms.

7. The photothermographic material according to claim 1, wherein 50 to 85% by mol of the non-photosensitive organic silver salts are silver behenate.

8. The photothermographic material according to claim 1, which comprises silver in amount of 1.9 $g/m^2$ or less.

9. The photothermographic material according to claim 1, which comprises silver in amount of 1.6 $g/m^2$ or less.

10. The photothermographic material according to claim 1, wherein the reducing agent is represented by the following formula (R):

(R)

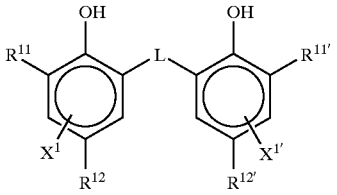

wherein $R^{11}$ and $R^{11'}$ each independently represent an alkyl group having 1 to 20 carbon atoms; $R^{12}$ and $R^{12'}$ each independently represent a hydrogen atom or a substituent capable of attaching to a benzene ring; L represents —S— or —$CHR^{13}$—, and $R^{13}$ represents a hydrogen atom or an alkyl group having 1 to 20 carbon atoms; and $X^1$ and $X^{1'}$ each independently represent a hydrogen atom or a substituent capable of attaching to a benzene ring.

11. The photothermographic material according to claim 1, which comprises a compound represented by the following formula (D) in the one side:

(D)

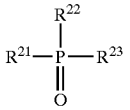

wherein $R^{21}$ to $R^{23}$ each independently represent an alkyl group, an aryl group, an alkoxy group, an aryloxy group, an amino group or a heterocyclic group, those may be either unsubstituted or substituted.

12. The photothermographic material according to claim 1, which comprises a compound represented by the following formula (H) in the one side:

$$Q—(Y)n—C(Z_1)(Z_2)X \quad (H)$$

wherein Q represents an alkyl group, an aryl group or a heterocyclic group; Y represents a divalent linking group; n is 0 or 1; $Z_1$ and $Z_2$ each represent a halogen atom; and X represents a hydrogen atom or an electron-withdrawing group.

13. The photothermographic material according to claim 1, which further comprises a development accelerator.

14. The photothermographic material according to claim 13, the development accelerator is a hydrazine compound.

15. The photothermographic material according to claim 2, wherein the photothermographic material comprises an undercoating layer comprising the compound represented by the formula (F).

* * * * *